US007331315B2

(12) United States Patent
Mavinahally

(10) Patent No.: US 7,331,315 B2
(45) Date of Patent: Feb. 19, 2008

(54) TWO-STROKE ENGINE WITH FUEL INJECTION

(75) Inventor: Nagesh S. Mavinahally, Anderson, SC (US)

(73) Assignee: Eastway Fair Company Limited (VG)

( * ) Notice: Subject to any disclaimer, the term of this patent is extended or adjusted under 35 U.S.C. 154(b) by 88 days.

(21) Appl. No.: 11/351,318

(22) Filed: Feb. 9, 2006

(65) Prior Publication Data

US 2006/0185632 A1 Aug. 24, 2006

Related U.S. Application Data

(60) Provisional application No. 60/655,741, filed on Feb. 23, 2005.

(51) Int. Cl.
*F02B 25/16* (2006.01)

(52) U.S. Cl. ..... 123/73 PP; 123/73 V

(58) Field of Classification Search ..... 123/73 PP, 123/73 V

See application file for complete search history.

(56) References Cited

U.S. PATENT DOCUMENTS

| | | | | |
|---|---|---|---|---|
| 666,264 | A | 1/1901 | Denison | |
| 991,063 | A | 5/1911 | Hopewell | |
| 1,790,302 | A | 1/1931 | Goiot | |
| 2,110,888 | A | 3/1938 | Meredith | |
| 2,481,901 | A | 9/1949 | Bracke | 123/73 |
| 2,531,699 | A | 11/1950 | Phelps | 123/73 |
| 2,893,362 | A | 7/1959 | Dalrymple | 123/73 |
| 3,119,380 | A | 1/1964 | Armstrong | 123/73 |
| 4,034,724 | A | 7/1977 | Flanagan | 123/75 B |
| 4,106,439 | A | 8/1978 | Kanao | 123/75 B |
| 4,176,631 | A | 12/1979 | Kanao | 123/73 PP |
| 4,296,714 | A | 10/1981 | Buchner | 123/53 B |
| 4,340,016 | A | 7/1982 | Ehrlich | 123/73 R |
| 4,362,132 | A | 12/1982 | Neuman | 123/73 D |
| 4,378,762 | A | 4/1983 | Ehrlich | 123/73 PP |
| 4,445,468 | A | 5/1984 | Onishi et al. | 123/73 C |
| 4,461,260 | A | 7/1984 | Nonaka et al. | 123/478 |
| 4,469,054 | A | 9/1984 | Onishi et al. | 123/74 R |

(Continued)

FOREIGN PATENT DOCUMENTS

| | | |
|---|---|---|
| EP | 0 925 0429 | 9/1997 |

(Continued)

OTHER PUBLICATIONS

LHD Series Control Valves, The Lee Company, Lee Electro-Fluidic Systems Technical Handbook Component Catalog with Engineering Reference Material, 2003, Release 7.1, (1p).

*Primary Examiner*—Stephen K. Cronin
*Assistant Examiner*—Jason Benton
(74) *Attorney, Agent, or Firm*—Brinks Hofer Gilson & Lione

(57) ABSTRACT

A two-stroke internal combustion engine is provided with a fuel injector. The two-stroke internal combustion engine may have at least one transfer passage, an air channel, and a fuel injector. The transfer passage is between a crankcase and a combustion chamber of the engine. The air channel is in gaseous communication with a top portion of the transfer channel. The fuel injector is in gaseous communication with the air channel and injects fuel into the air channel. The two-stroke engine may be used on hand-held, lawn and garden equipment.

17 Claims, 24 Drawing Sheets

U.S. PATENT DOCUMENTS 4,481,910 A 11/1984 Sheaffer ..... 123/73 R
4,630,591 A 12/1986 Hooper ..... 123/65 S
4,809,648 A 3/1989 Luo ..... 123/73 AA
5,009,211 A 4/1991 Kushida et al. ..... 123/491
5,027,759 A 7/1991 Luo ..... 123/73 PP
5,050,551 A 9/1991 Morikawa ..... 123/305
5,105,775 A 4/1992 Maissant ..... 123/70 R
5,201,288 A 4/1993 Doragrip ..... 123/73 DA
5,273,004 A 12/1993 Duret et al. ..... 123/73 V
5,291,866 A 3/1994 Kosa ..... 123/317
5,379,732 A 1/1995 Mavinahally et al. ... 123/73 AA
5,425,346 A 6/1995 Mavinahally ..... 123/568
5,503,119 A 4/1996 Glover ..... 123/73 B
5,582,156 A 12/1996 Cullum et al. ..... 123/672
5,613,468 A 3/1997 Ibara et al. ..... 123/73 A
5,628,295 A 5/1997 Todero et al. ..... 123/568
5,690,063 A 11/1997 Motoyama et al. ..... 123/73 A
5,778,838 A * 7/1998 Taue ..... 123/73 B
5,803,050 A 9/1998 Osakabe et al. ..... 123/456
5,901,673 A 5/1999 Ishikawa ..... 123/73 B
5,947,066 A 9/1999 Ishikawa ..... 123/65 P
6,085,703 A 7/2000 Noguchi ..... 123/73 R
6,101,991 A 8/2000 Glover ..... 123/73 PP
6,109,223 A 8/2000 Motoyama et al. ..... 123/73 A
6,135,072 A 10/2000 Kishita ..... 123/73 A
6,142,118 A 11/2000 Motose ..... 123/339.1
6,173,683 B1 1/2001 Nemoto et al. ..... 1/16
6,216,650 B1 4/2001 Noguchi ..... 123/73 A
6,240,886 B1 6/2001 Noguchi ..... 123/73 AA
6,257,179 B1 7/2001 Uenoyama et al. ..... 123/65 R
6,257,181 B1 7/2001 Rosskamp et al. ..... 123/73 AA
6,263,841 B1 7/2001 Beveridge ..... 123/73 R
6,267,088 B1 7/2001 Rosskamp et al. ..... 123/73 PP
6,286,469 B1 9/2001 Cobb, Jr. ..... 123/73 C
6,289,856 B1 9/2001 Noguchi ..... 123/73 PP
6,352,058 B1 3/2002 Yuasa et al. ..... 123/73 R
6,367,432 B1 4/2002 Araki ..... 123/73 R
6,378,481 B1 4/2002 Conradty et al. ..... 123/190.2
6,408,805 B2 6/2002 Uenoyama et al. ..... 123/73 PP
6,418,891 B2 7/2002 Kobayashi ..... 123/73 PP
6,427,646 B2 8/2002 Galka et al. ..... 123/73 C
6,427,647 B1 8/2002 Galka et al. ..... 123/73 B
6,497,204 B1 12/2002 Miyazaki et al. ..... 123/73 PP
6,513,466 B2 2/2003 Bignion et al. ..... 123/73 A
6,539,900 B2 4/2003 Laimbock ..... 123/73 PP
6,564,760 B2 5/2003 Laydera-Collins ..... 123/73 AA
6,564,761 B2 5/2003 Uenoyama et al. ..... 123/73 PP
6,606,971 B2 8/2003 Abei ..... 123/73 C
6,647,713 B1 * 11/2003 Miyajiri et al. ..... 60/302
6,662,765 B2 12/2003 Araki ..... 123/73 A
6,662,766 B2 12/2003 Araki et al. ..... 123/73 PP
6,668,770 B2 * 12/2003 Carlsson et al. ..... 123/73 A
6,668,771 B2 12/2003 Martinsson ..... 123/73 A
6,691,649 B2 2/2004 Zauner et al. ..... 123/73 B
6,691,650 B2 2/2004 Zama et al. ..... 123/73 PP
6,712,029 B1 3/2004 Andersson et al. ..... 123/73 R
6,718,917 B2 * 4/2004 Andersson et al. ..... 123/73 PP
6,729,275 B2 5/2004 Laimbock ..... 123/73 PP
6,729,276 B2 5/2004 Uenoyama et al. ..... 123/73
6,802,284 B2 10/2004 Hironaka et al. ..... 123/73 A
6,817,323 B2 11/2004 Notaras et al. ..... 123/73 A
6,901,892 B2 6/2005 Mavinahally et al. ..... 123/73 V
6,976,457 B2 * 12/2005 Klaric ..... 123/73 A
7,000,581 B1 2/2006 Mavinahally et al. .... 123/90.24
7,017,537 B2 3/2006 Osburg et al. ..... 123/73 A
2001/0011531 A1 8/2001 Uenoyama et al. ..... 123/65 R
2001/0029912 A1 10/2001 Laimbock ..... 123/73 PP
2002/0104493 A1 8/2002 Fukuoka et al.
2002/0139327 A1 10/2002 Uenoyama et al. ..... 123/73 PP
2003/0029398 A1 * 2/2003 Andersson et al. ..... 123/73 PP
2003/0051684 A1 3/2003 Laydera-Collins ..... 123/73 AA
2003/0106509 A1 6/2003 Uenoyama et al. ..... 123/73 PP
2003/0192493 A1 10/2003 Yuasa et al. ..... 123/73 PP
2004/0003784 A1 1/2004 Rosskamp et al. ..... 123/73 R
2004/0025817 A1 2/2004 Uenoyama et al. ..... 123/73 A
2004/0040522 A1 3/2004 Mavinahally et al. ..... 123/73 V
2004/0045517 A1 * 3/2004 Fleig et al. ..... 123/73 PP
2004/0065280 A1 4/2004 Sheldon et al. ..... 123/73 PP
2004/0065281 A1 4/2004 Sheldon et al. ..... 123/73 PP
2004/0079304 A1 * 4/2004 Notaras et al. ..... 123/73 F
2004/0168656 A1 9/2004 Carlsson et al. ..... 123/73 PP
2004/0251564 A1 12/2004 Mavinahally ..... 261/23.3
2004/0255883 A1 12/2004 Yuasa et al. ..... 123/73 A
2005/0022757 A1 2/2005 Yamaguchi et al. ..... 123/73 PP
2005/0139179 A1 6/2005 Mavinahally et al. ..... 123/73 A
2006/0005794 A1 1/2006 Mavinahally ..... 123/65 PE
2006/0005795 A1 * 1/2006 Yuasa et al. ..... 123/73 PP
2006/0272600 A1 * 12/2006 Tsutsui et al. ..... 123/73 PP
2007/0028868 A1 * 2/2007 Tsutsui ..... 123/73 PP

FOREIGN PATENT DOCUMENTS

EP 0 992 660 A1 6/1998

* cited by examiner

TWO-STROKE ENGINE WITH FUEL INJECTION

This application claims priority to U.S. Provisional Application No. 60/655,741, filed Feb. 23, 2005, which is hereby incorporated by reference herein.

BACKGROUND

The present invention relates to two stroke engines, and more particularly to two-stroke engines having scavenging or transfer passages with fuel injection.

Conventional two-stroke engines suffer from high hydrocarbon emissions and poor fuel efficiency because they use a fresh fuel-air mixture to scavenge the combustion chamber. It is known in the prior art to reduce the system-caused scavenging losses in two-stroke engines by advancing fuel-free scavenging air ahead of a fuel-air mixture. This reduces the fuel that is lost due to short circuiting fresh fuel-air mixture in the combustion chamber with the exhaust port.

Scavenging two stroke engines with stratified air-heads have been developed to address this problem. One example of such an engine is described in U.S. Patent Application No. 2004/0040522, filed May 28, 2003, and entitled Two Stroke Engine With Rotatably Modulated Gas Passage. In this design, the stratified air-head two-stroke engine inducts scavenging air from the top of transfer passages through reed valves or piston porting. However, this design also requires a special carburetor requiring two valves, one for air and the other for the air-fuel mixture.

For the foregoing reasons, there is a need for a two-stroke engine that eliminates the need for a custom designed carburetor and provides for self-regulating fuel-metering with improved engine performance.

BRIEF SUMMARY

Accordingly, embodiments of the present invention provide a new and improved two-stroke engine with pulse injection for the air-head. A single air channel and a sequential pulsed fuel injector allow for a lower cost engine with improved performance. Because air is inducted into the engine through the top of the transfer passages and fuel is injected into this air, it is possible to cut off fuel during induction and allow the transfer passages to contain substantially fuel-free air for stratified scavenging. In addition, reduced emissions may be achieved without the use of a catalyst.

The two-stroke engine may have a fuel injector that is responsive to an electronic control unit. The two-stroke engine may also have a transfer passage between a crankcase and a combustion chamber of the engine. The two-stroke engine is especially suited for hand-held, lawn and garden equipment.

DETAILED DESCRIPTION

Figure 1A:
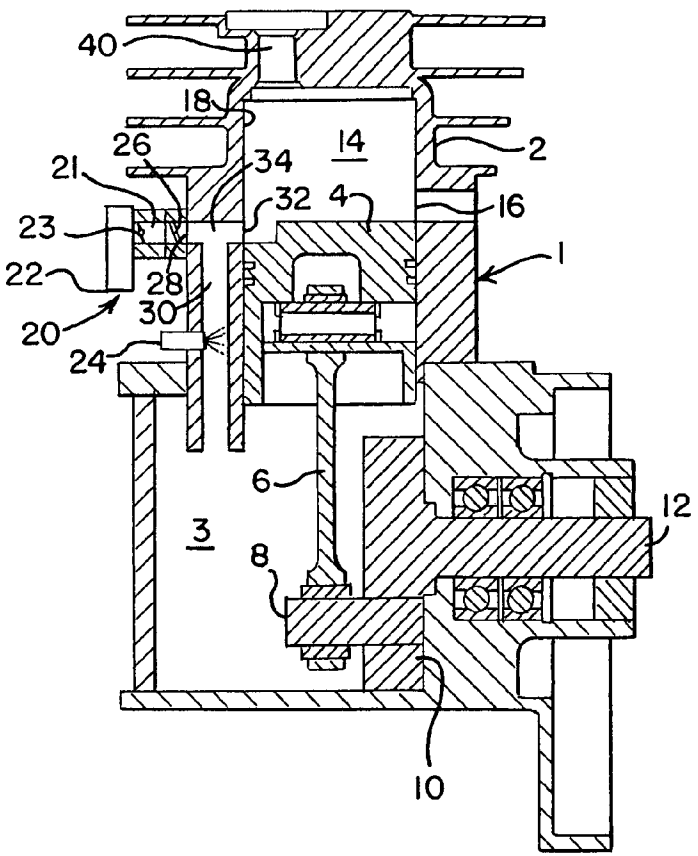
FIG. 1A shows a front cross section view of another embodiment of a two-stroke engine of the present invention where the fuel injector is in the cylinder wall.
Figure 1:
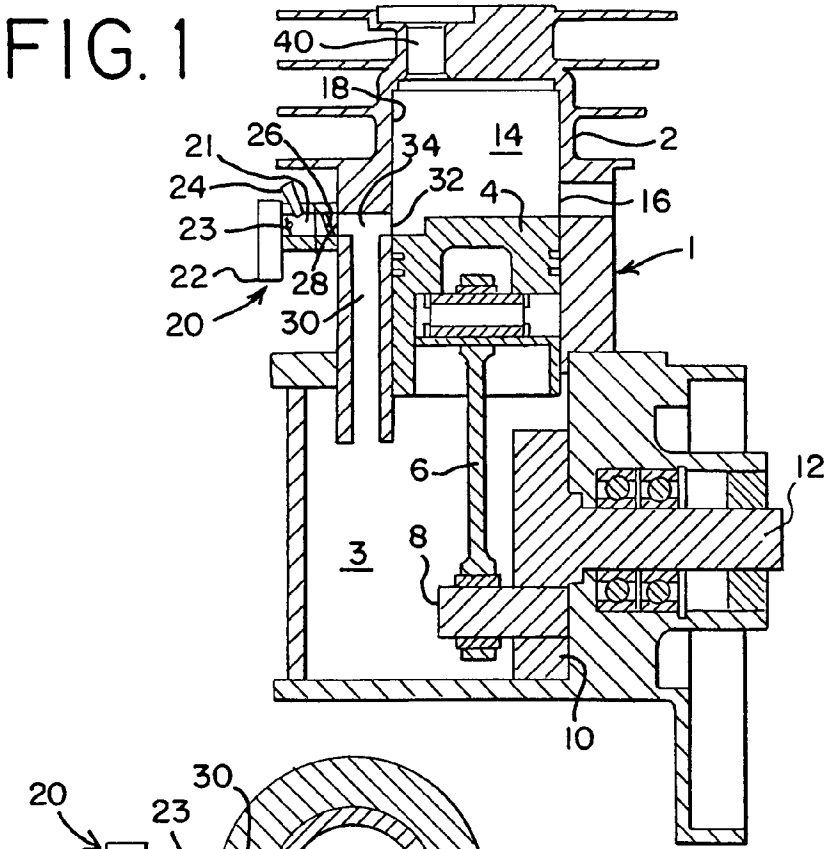
FIG. 1 shows a front cross section view of one embodiment of a two-stroke engine of the present invention.
Figure 2:
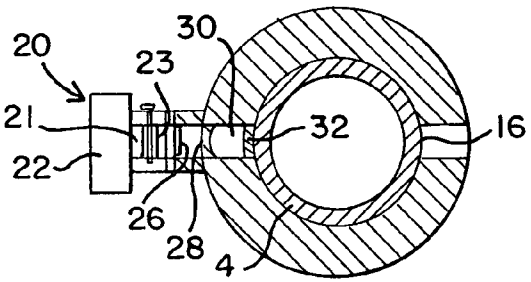
FIG. 2 shows a top cross section view of the two-stroke engine of FIG. 1.

Referring now to FIGS. 1 and 2, one embodiment of a half-crank two-stroke engine 1 is shown. The engine 1 includes a cylinder 2 and a crankcase 3. A piston 4 is reciprocally mounted within the cylinder 2 and is connected by a connecting rod 6 to a crank throw 8 on a circular crank web 10 of a crankshaft 12. A combustion chamber 14 is formed in the cylinder 2 and is delimited by the piston 4. One end of the crankshaft 12 includes the crank web 10 for weight compensation and rotational balancing.

The combustion chamber 14 is connected through an exhaust port 16 formed in the cylinder wall 18 to an exhaust gas-muffler or similar exhaust-gas discharging unit (not shown). The exhaust port 16 permits exhaust gas to flow out of the combustion chamber 14 and into the exhaust gas-muffler.

The engine 1 includes a scavenging system including at least one transfer passage 30 between the crankcase 3 and the combustion chamber 14. The transfer passage 30 is used for scavenging and allowing a fresh fuel-air charge to be drawn from the crankcase 3 into the combustion chamber 14 through a transfer port 32 in the cylinder wall 18 at the completion of a power stroke. The transfer passage 30 may be formed as an open channel in the cylinder wall 18 so that it is open. Alternately, the transfer passage 30 may be formed as closed passage in the cylinder wall 18, with openings at each end.

An intake system 20 supplies the scavenging air and the fuel-air charge necessary to operate the engine 1. The intake system 20 is formed as a single air passage 21 connected to the top portion 34 of the transfer passage 30 and includes an air filter 22, a throttle valve 23, a fuel injector 24, a reed valve 26, and an inlet port 28 formed in the wall 18 of the cylinder 2. As seen in FIG. 1, the fuel injector 24 is positioned upstream of the reed valve 26. This placement will improve sealing and lubrication of the reed valve 26. Because the fuel used in a two-stroke engine is generally premixed with oil, the injected fuel-oil mixture will form a thin layer of oil film on the surface of the reed petal (not shown) of the reed valve 26. This oil layer helps seal the surfaces between the reed petal and the reed block (not shown). In addition, fuel contacting the reed petal will cool the petal.

The throttle valve 23 controls the amount of air that flows into the engine 1. A butterfly valve may be used for throttle valve 23, although other types of valves may also be used. When the pressure in the transfer passage 30 and crankcase 3 drops below ambient pressure, the reed valve 26 opens, allowing fresh air to flow through the air filter 22 and into the transfer passage 30 and crankcase 3. A control algorithm may be used to control the injection of fuel from the fuel injector 24. The control algorithm may monitor engine parameters such as crankshaft position, engine speed, engine torque, throttle position, exhaust temperature, intake manifold pressure, intake manifold temperature, crankcase pressure, ambient temperature and other operating conditions affecting engine performance. Examples of such control algorithms are described in U.S. Pat. No. 5,009,211, issued Apr. 23, 1991, and entitled Fuel Injection Controlling Device for Two-Cycle Engine, and U.S. Pat. No. 5,050,551, issued Sep. 24, 1991, and entitled System For Controlling Ignition Timing and Fuel Injection Timing of a Two-Cycle Engine, the contents of which are hereby incorporated by reference.

Figure 3:
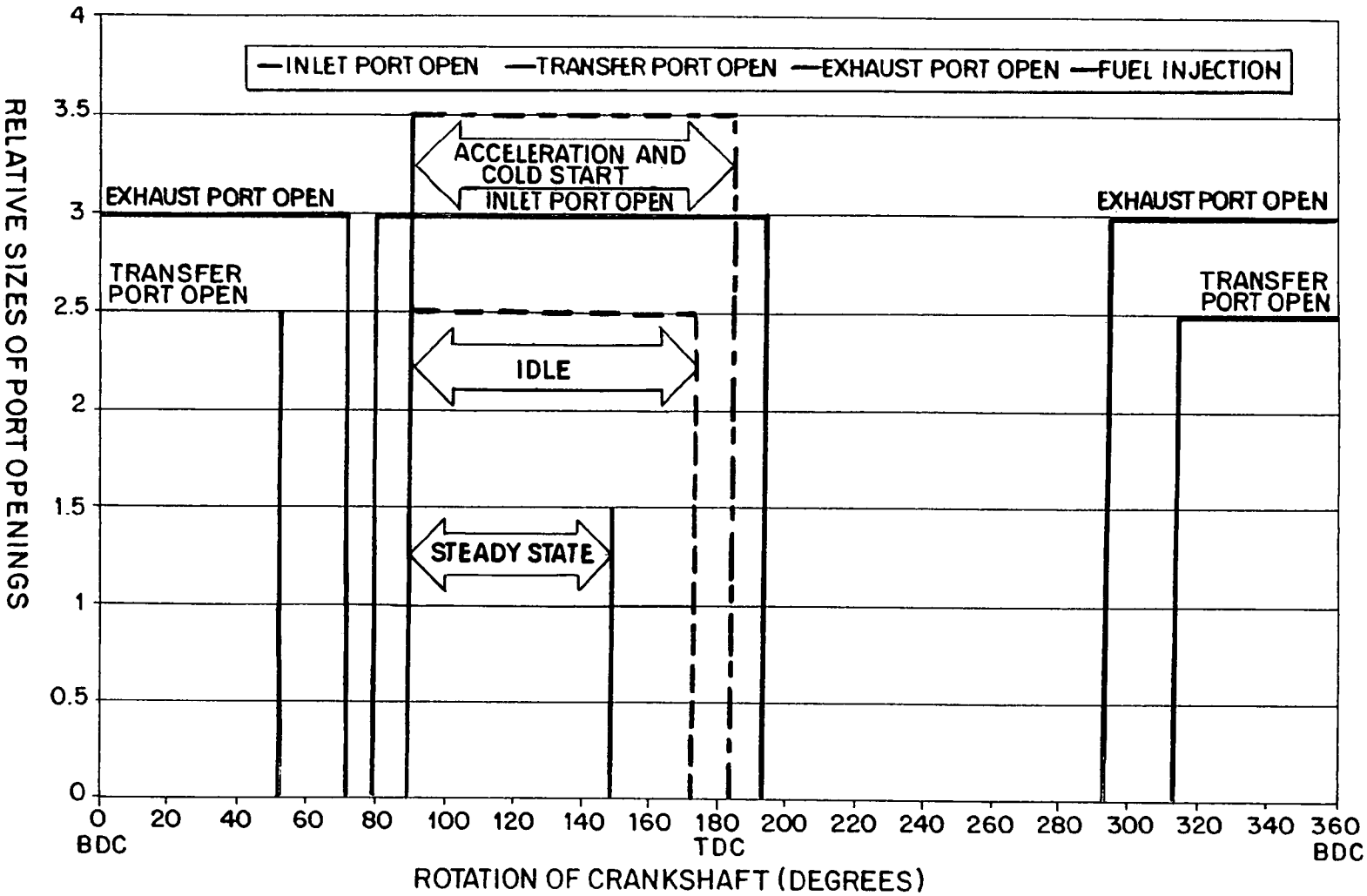
FIG. 3 shows a timing diagram for a two-stroke engine having a reed valve controlled intake system.

FIG. 3 illustrates a timing diagram of the engine 1 having a reed valve controlled intake system. The rotation in degrees of the crankshaft 12 is plotted along the x-axis, while the y-axis represents the relative sizes of the port areas for the transfer port 32 and exhaust ports 16, showing that exhaust port 16 area is greater than the transfer port 32 area. In operation, as the piston 4 is at a bottom dead center position (BDC), the exhaust port 16 is open to exhaust gases from the combustion chamber 14 to ambient. In addition, the transfer port 32 is also open, inducting scavenging air and the fuel-air charge from transfer passage 30 and crankcase 3 to combustion chamber 14. Scavenging air flows into the combustion chamber first, before the fuel-air mixture. This scavenging process flushes the combustion chamber 14 of combustion products and reduces the amount of fuel-air mixture that is directly short-circuited through the exhaust port 16. As the piston 4 rises, first the transfer port 32 and then the exhaust port 16 are closed. As the piston 4 continues to rise, the pressure in the crankcase 3 drops below ambient, which opens reed valve 26. This inducts fresh scavenging air through the air filter 22 and inlet port 28 into the top portion 34 of transfer passage 30.

The fuel injector 24 injects fuel directly into the scavenging air to form a fuel-air mixture. This fuel-air mixture flows through the inlet port 28 into the top portion 34 of transfer passage 30, eventually reaching the crankcase 3. The stratification is determined by the duration of the fuel injection, while the start and end of the fuel injection depends on the operating condition of the engine 1. For example, for a steady state operating condition, the fuel injection ends before the induction of air. As a result, only air continues to flow into the transfer passage 30, which leaves a scavenging air layer in the transfer passage 30, with the fuel-air mixture in the crankcase 3. For a cold start, the fuel injection may start early and end late, resulting in a richer fuel-air mixture and with little or no stratification. During engine idling or warm-up, the stratification may be achieved or increased gradually. For engine acceleration, the fuel injection may start slightly sooner than the inlet port 28 opening and continue past the end of fuel injection for a steady state, but before the end of induction of air. This provides an extra rich fuel-air mixture. For engine deceleration, it may be possible to cut off fuel completely or inject only a small fraction of fuel-oil mixture to help lubricate the parts if the deceleration occurs for an extended length of time. The algorithm may also be designed so that the injector 24 cuts off fuel completely for skip injection during idling, where the engine 1 fires intermittently to save fuel and lower emissions.

As the piston 4 reaches a top dead center position (TDC), fuel and air in the combustion chamber have been compressed and a spark plug 40 ignites the mixture. The resulting explosion drives the piston 4 downward. As the piston 4 moves downward, the fuel-air mixture in the crankcase 3 is compressed, increasing the pressure in the crankcase 3 and closing reed valve 26. As the piston 4 approaches the bottom of its stroke, the exhaust port 16 and the transfer port 32 are opened, repeating the cycle described above.

FIG. 1A illustrates an alternate position for the fuel injector 24 of the two-stroke engine 1 where the fuel injector 24 is repositioned to inject fuel directly into the transfer passage 30. As described further below, this placement of fuel injector 24 may improve the stratification of the fuel-free scavenging air in the transfer passages 30 and the fuel-air mixture in the crankcase 3.

Figure 4:
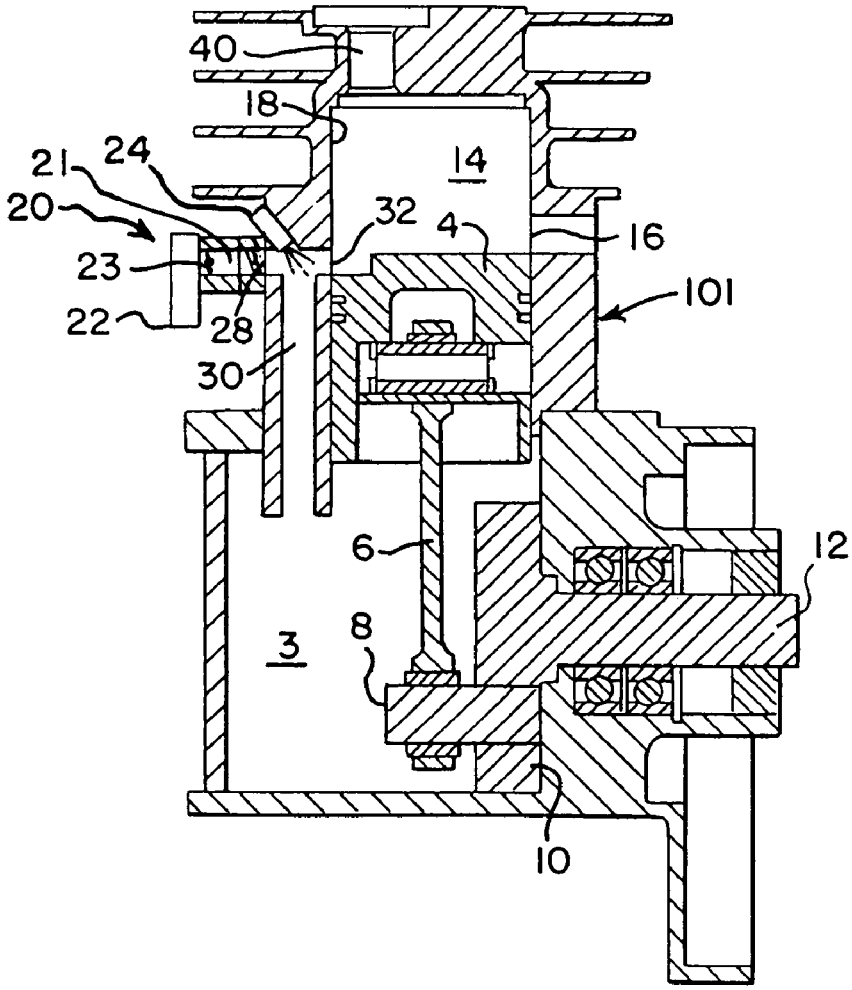
FIG. 4 shows a front cross section view of another embodiment of a two-stroke engine of the present invention.
Figure 5:
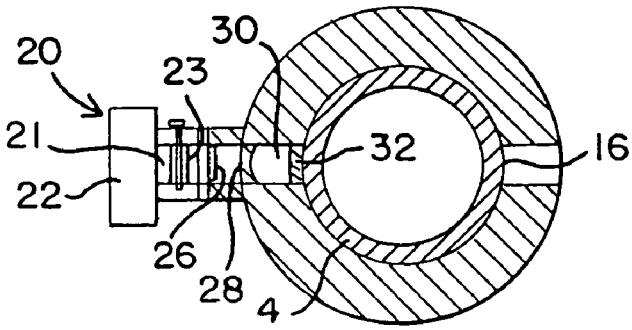
FIG. 5 shows a top cross section view of the two-stroke engine of FIG. 4.

A second embodiment of a two-stroke engine 101 is illustrated in FIGS. 4 and 5. The fuel injector 24 is positioned downstream of the reed valve 26, closer to the piston 4. This downstream placement of the fuel injector 24 may help cool the piston 4. By injecting fuel closer to the piston 4 or by having the fuel impinge on the piston helps to cool the piston due to the heat of vaporization of the fuel. The fuel is at a lower temperature (ambient) than the surface temperature of the piston. The fuel that impinges on the piston skirt or surface absorbs the heat from the piston and cools it. Other aspects of engine 101 are similar to the engine 1 shown in FIGS. 1 and 2 and described above.

Figure 7:
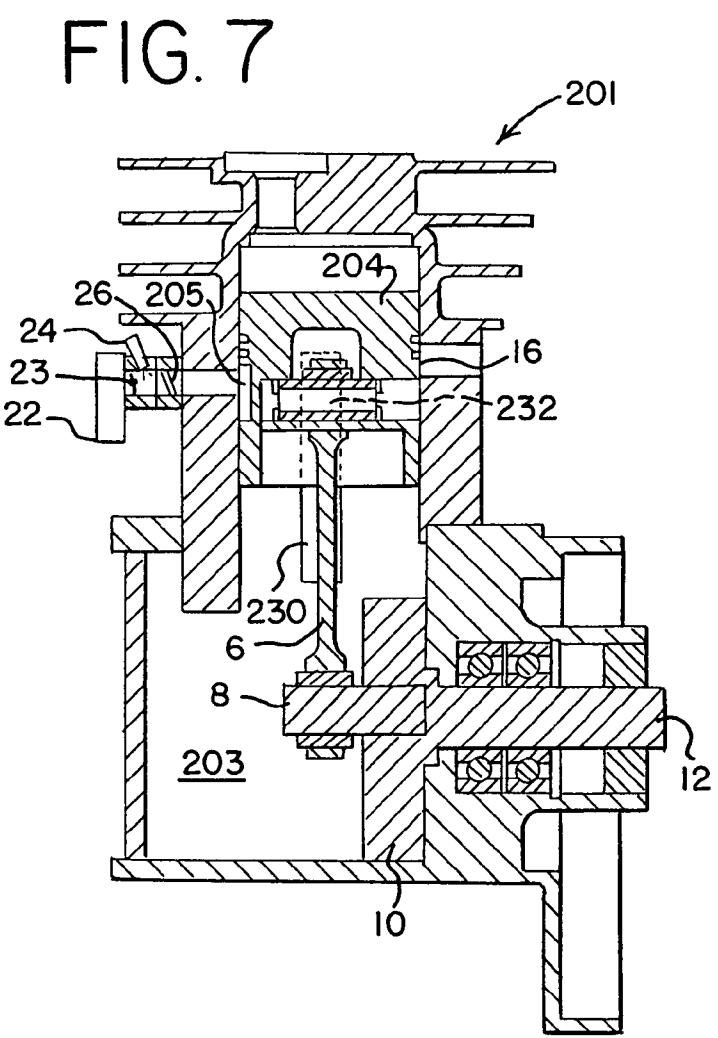
FIG. 7 shows a front cross section view of another embodiment of a two-stroke engine of the present invention near TDC.
Figure 6:
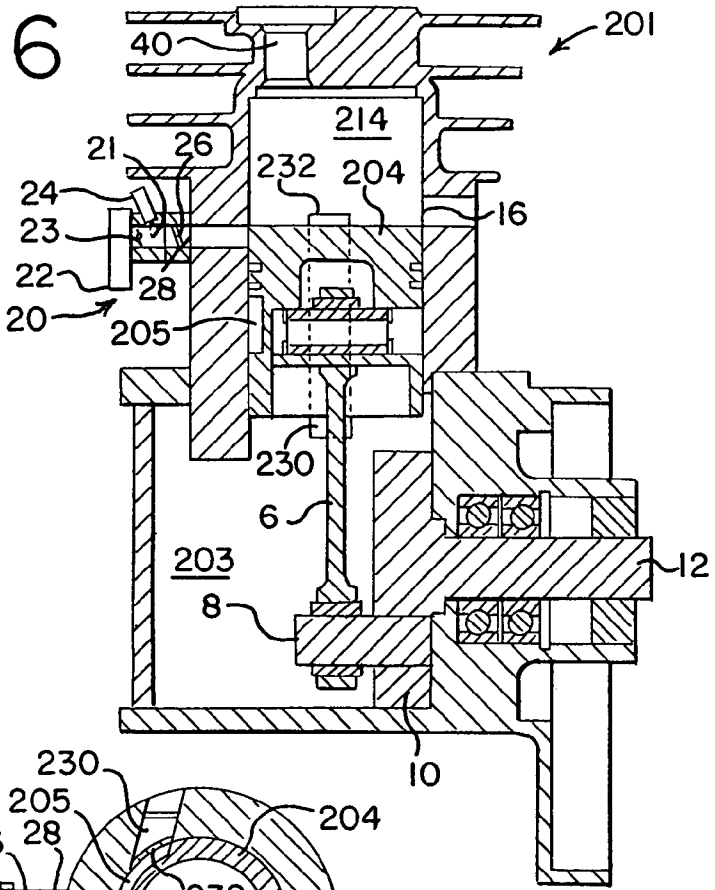
FIG. 6 shows a front cross section view of another embodiment of a two-stroke engine of the present invention near BDC.
Figure 8:
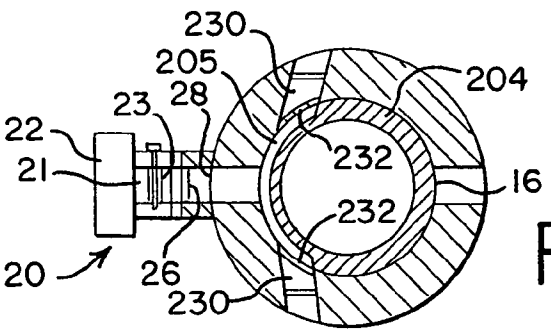
FIG. 8 shows a top cross section view of the two-stroke engine of FIGS. 6-7.
Figure 9:
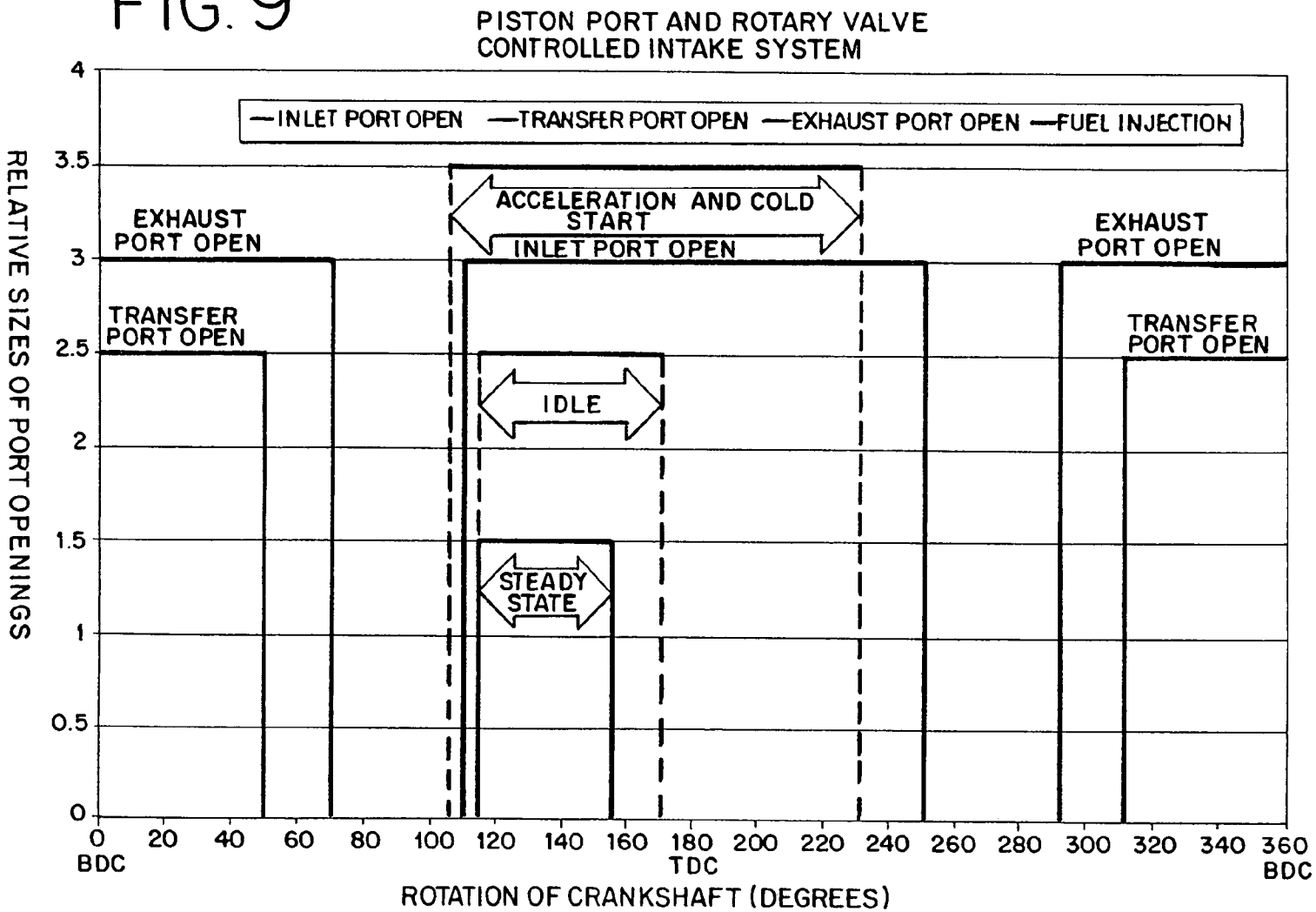
FIG. 9 shows a timing diagram for a two-stroke engine having a piston port and rotary valve controlled intake system.

A third embodiment of a two-stroke engine 201 is illustrated in FIGS. 6-8. Engine 201 has a piston 204 with a circumferential channel 205. This circumferential channel 205 is alignable with the inlet port 28 and transfer ports 232. As the circumferential channel 205 is aligned with the inlet port 28 and the transfer ports 232, the air and fuel-air mixture from inlet port 28 flows through the channel 205 to transfer ports 232 into a pair of transfer passages 230. Circumferential channel 205 may also be formed as a slot, groove, cut-out, or other shape. FIG. 9 illustrates the timing diagram of the engine 201 having a piston-ported controlled intake system. The timing sequence is similar to that described in FIG. 3. As with FIG. 3, the rotation in degrees of the crankshaft 12 is plotted along the x-axis of FIG. 9, while the y-axis of FIG. 9 represents the relative sizes of the port areas for the transfer port 232 and exhaust ports 16, showing that exhaust port 16 area is greater than the transfer port 232 area.

In operation, as the piston 204 is at BDC, the exhaust port 16 is open to exhaust gases from the combustion chamber 214 to ambient. In addition, the transfer port 232 are also open, inducting stratified scavenging air and a fuel-air charge from the pair of transfer passages 230 and crankcase 203 to combustion chamber 214. Scavenging air flows into the combustion chamber first, before the fuel-air mixture. As the piston 204 rises, the sidewall of the piston first closes the transfer port 332 and then the exhaust port 16. As the piston 204 continues to rise, the pressure in the crankcase 203 drops below ambient, which opens reed valve 26. This inducts fresh scavenging air through the air filter 22 and inlet port 28. When the circumferential channel 205 aligns with the transfer ports 232 and inlet port 28, gaseous communication is established between the intake system 20 and the transfer passages 230 and crankcase 203. This allows the scavenging air and the fuel-air mixture to flow through the inlet port 28 and into the transfer passages 230, eventually reaching the crankcase 203.

As the piston 204 reaches TDC, fuel and air in the combustion chamber have been compressed and a spark plug 40 ignites the mixture. The resulting explosion drives the piston 204 downward. As the piston 204 moves downward, the fuel-air mixture in the crankcase 203 is compressed, increasing the pressure in the crankcase 203 and closing reed valve 26. As the piston 204 approaches the bottom of its stroke, the exhaust port 16 and the transfer ports 232 are opened, repeating the cycle described above. Other aspects of engine 201 are similar to the engine 1 shown in FIGS. 1 and 2 and described above.

Figure 11:
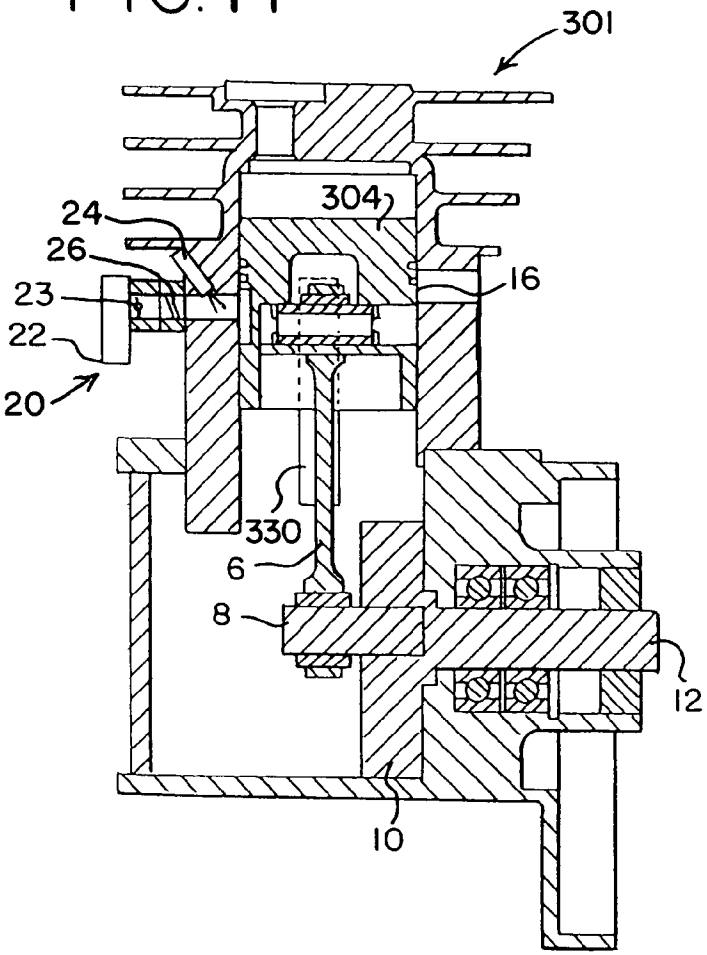
FIG. 11 shows a front cross section view of another embodiment of a two-stroke engine of the present invention near TDC.
Figure 10:
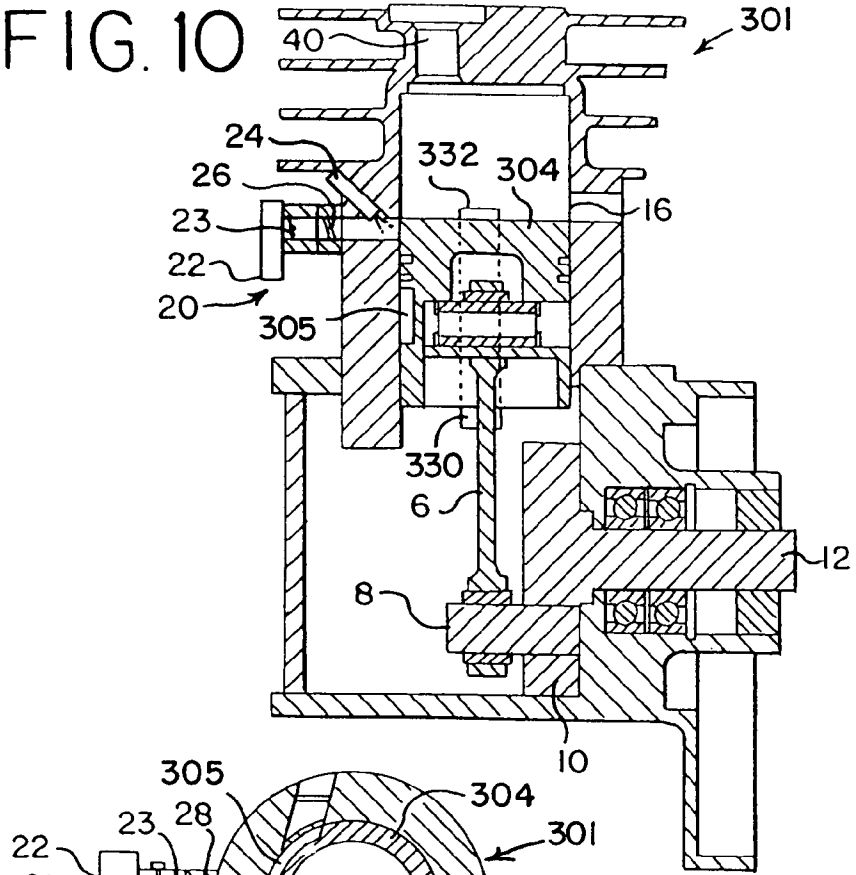
FIG. 10 shows a front cross section view of another embodiment of a two-stroke engine of the present invention near BDC.
Figure 12:
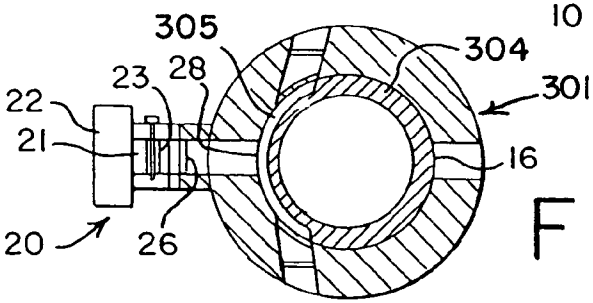
FIG. 12 shows a top cross section view of a two-stroke engine of FIGS. 10-11.
Figure 14:
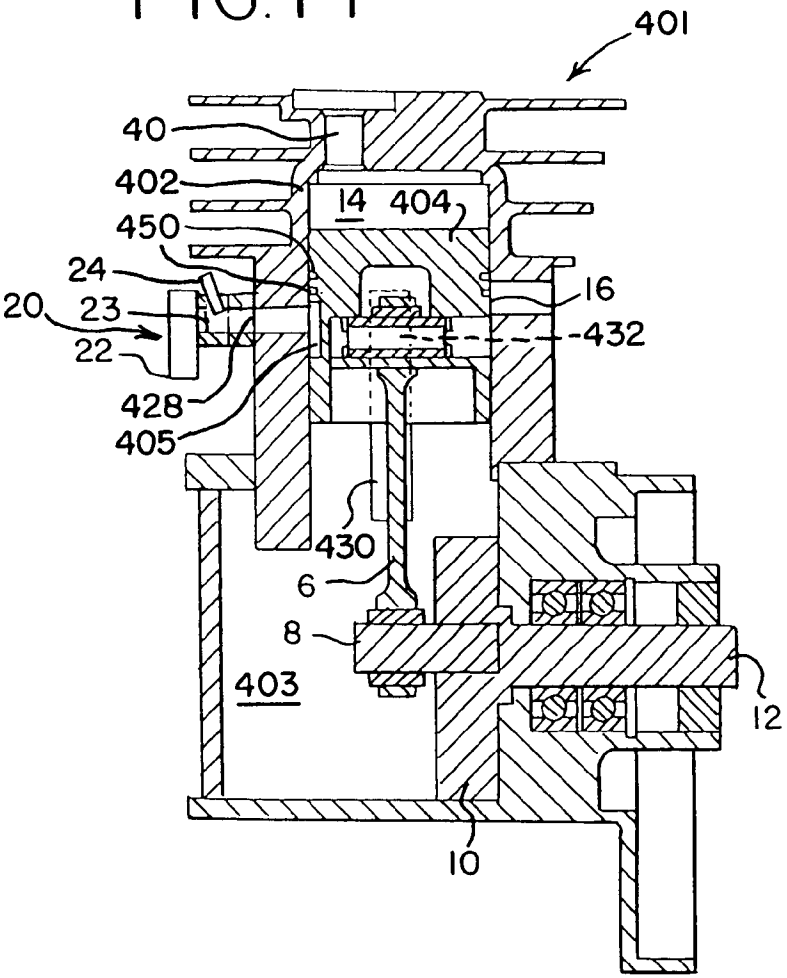
FIG. 14 shows a front cross section view of another embodiment of a two-stroke engine of the present invention near TDC.
Figure 13:
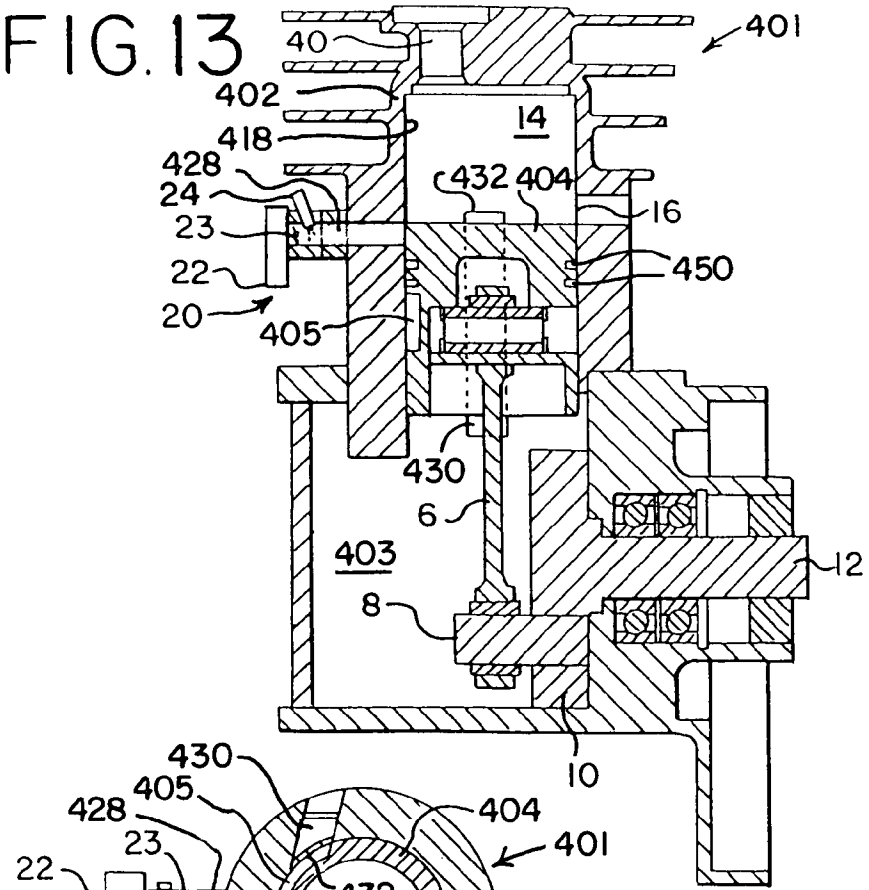
FIG. 13 shows a front cross section view of another embodiment of a two-stroke engine of the present invention near BDC.
Figure 15:
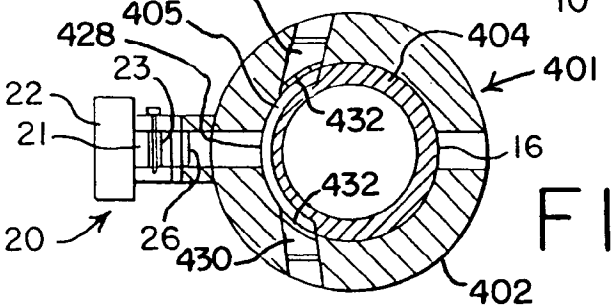
FIG. 15 shows a top cross section view of the two-stroke engine of FIGS. 13-14.
Figure 17:
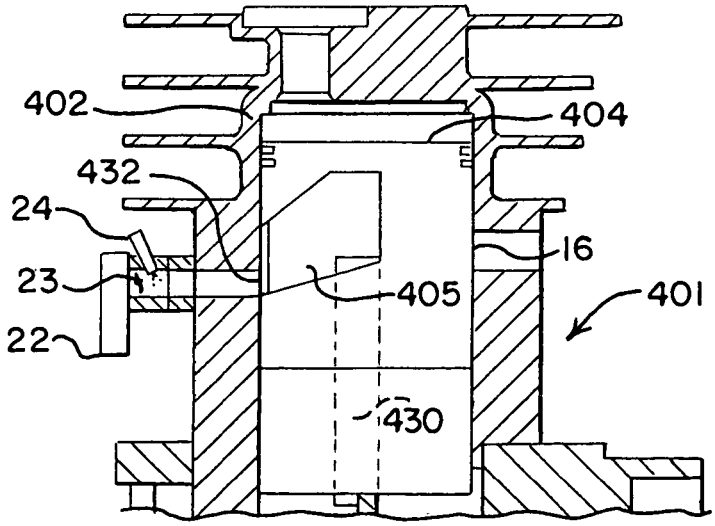
FIG. 17 shows a front cross section view of an embodiment of a two-stroke engine of the present invention having piston ports near TDC.

A fourth embodiment of a two-stroke engine 301 is illustrated in FIGS. 10-12. As with engine 101, the fuel injector 24 is positioned downstream of the reed valve 26, closer to the piston 304. This downstream placement of the fuel injector 24 may help cool the piston 304, as described above. Other aspects of engine 301 are similar to the engines 1 and 201 shown in FIGS. 1-3, 6-9 and described above.

A fifth embodiment of a two-stroke engine 401 using a piston controlled loop scavenged system is illustrated in FIGS. 13-17. In engine 401, the reed valve used in the other embodiments described above is eliminated. Instead, the piston 404 is configured such that the transfer ports 432 of the transfer passages 430 are sealably closed by the reciprocating piston 404 in the cylinder 402. When the circumferential channel 405 is not aligned with the inlet port 428 and the transfer ports 432, a piston skirt 450 on the outer circumference of the piston 404 engages the cylinder wall 418, closing the transfer passages 430 to the inlet port 428. Only when the circumferential channel 405 is aligned with the inlet port 428 and the transfer ports 432 are the transfer passages 430 open. Other aspects of engine 401 are similar to the engines 1 and 201 shown in FIGS. 1-3, 6-9 and described above.

Figure 16:
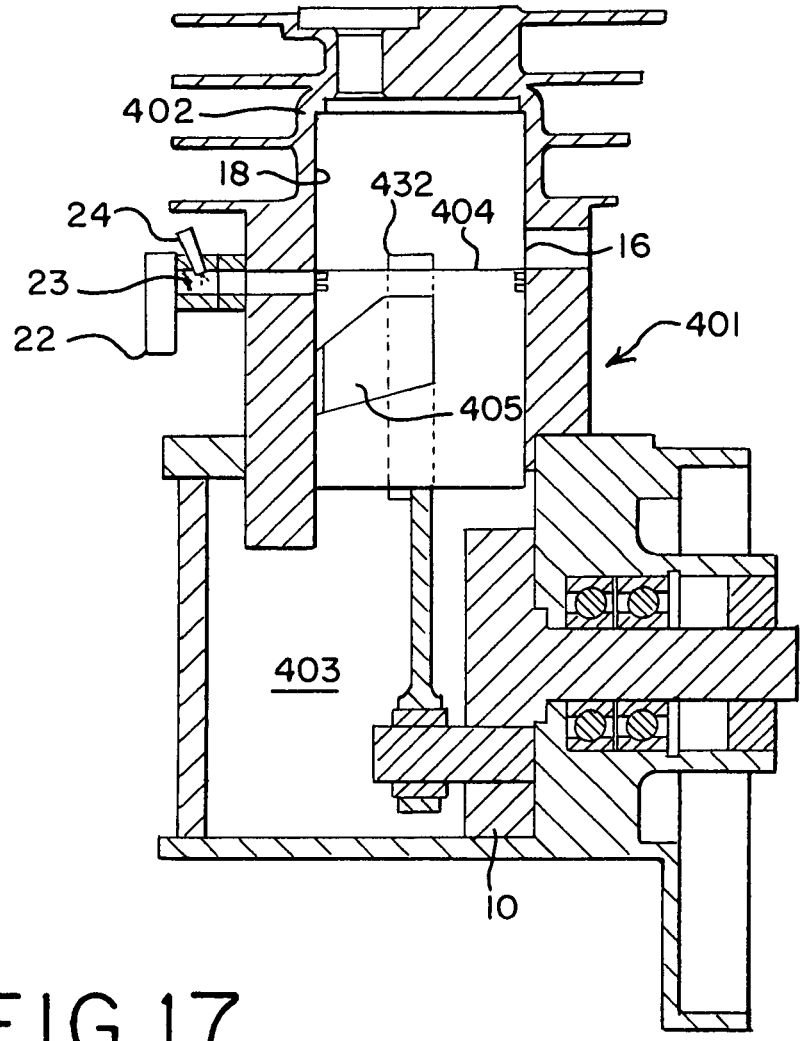
FIG. 16 shows a front cross section view of an embodiment of a two-stroke engine of the present invention having piston ports near BDC.
Figure 16A:
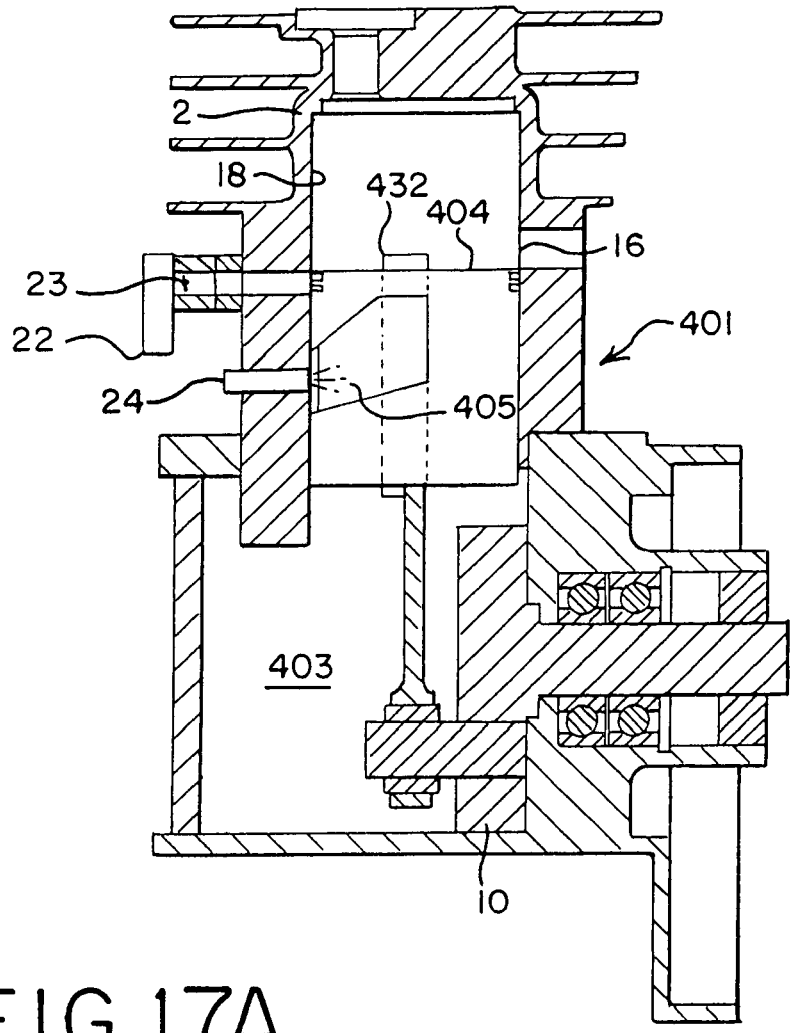
FIG. 16A shows a front cross section view of another embodiment of a two-stroke engine of the present invention having piston ports near BDC where the fuel injector is in the cylinder wall.
Figure 17A:
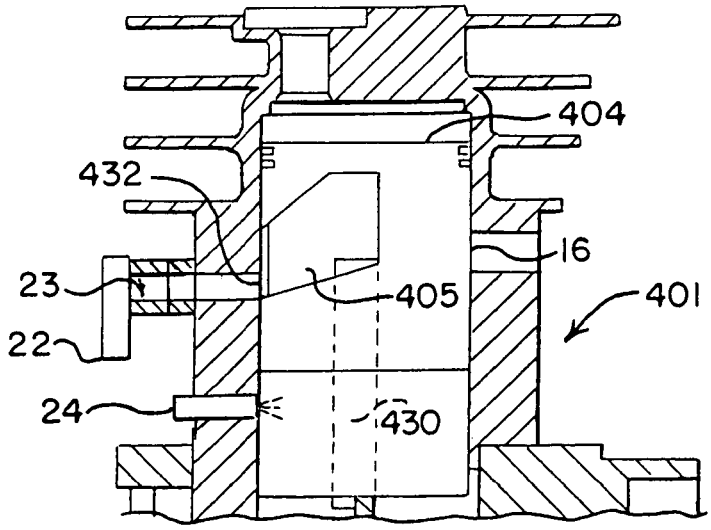
FIG. 17A shows a front cross section view of an embodiment of a two-stroke engine of the present invention having piston ports near TDC where the fuel injector is in the cylinder wall.

FIGS. 16A and 17A illustrate an alternate position for the fuel injector 24 of the two-stroke engine 401 where the fuel injector 24 is repositioned to inject fuel directly into the circumferential channel 405. As described further below, this placement of fuel injector 24 may improve the stratification of the fuel-free scavenging air in the transfer passages 430 and the fuel-air mixture in the crankcase 403.

Figure 19:
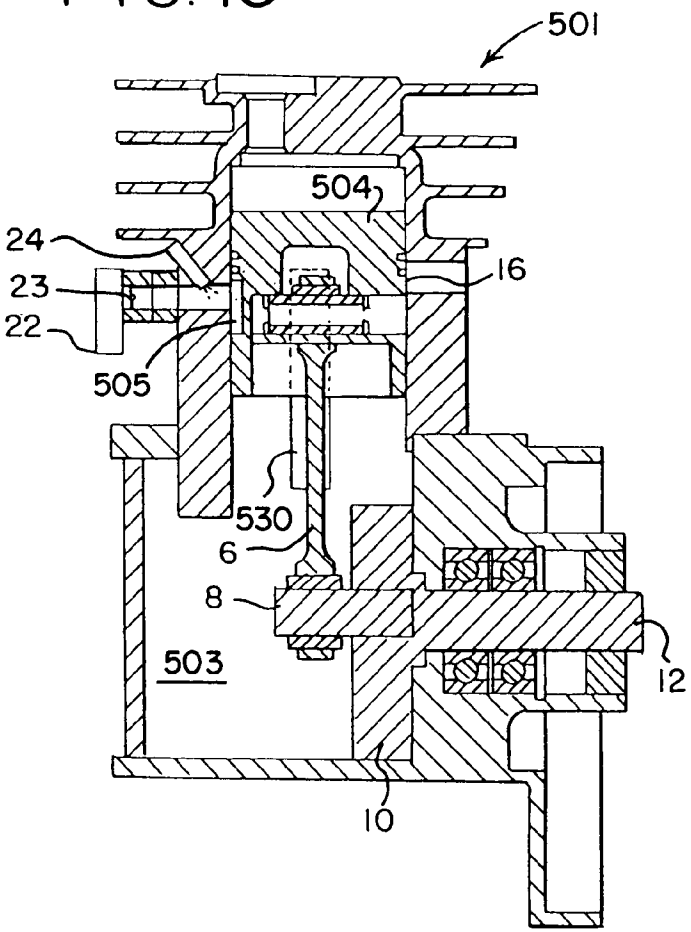
FIG. 19 shows a front cross section view of another embodiment of a two-stroke engine of the present invention near TDC.
Figure 18:
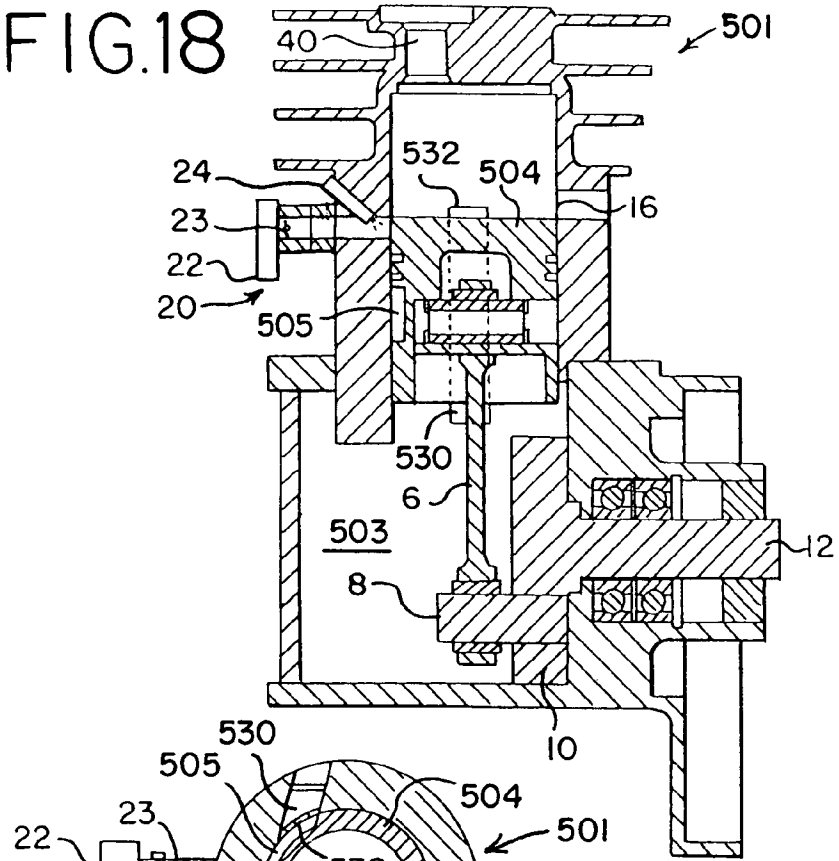
FIG. 18 shows a front cross section view of another embodiment of a two-stroke engine of the present invention near BDC.
Figure 20:
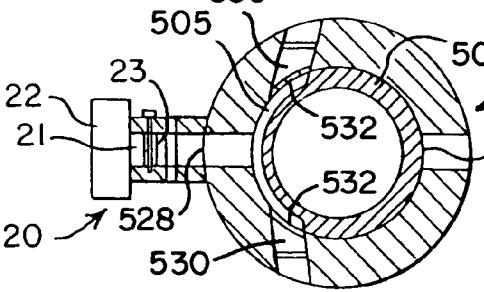
FIG. 20 shows a top cross section view of the two-stroke engine of FIGS. 18-19.

A sixth embodiment of a two-stroke engine 501 is illustrated in FIGS. 18-20. The fuel injector 24 is positioned closer to the piston 504. This placement of the fuel injector 24 may help cool the piston 504, as described above. Other aspects of engine 501 are similar to the engine 401 shown in FIGS. 13-17 and described above.

Figure 21:
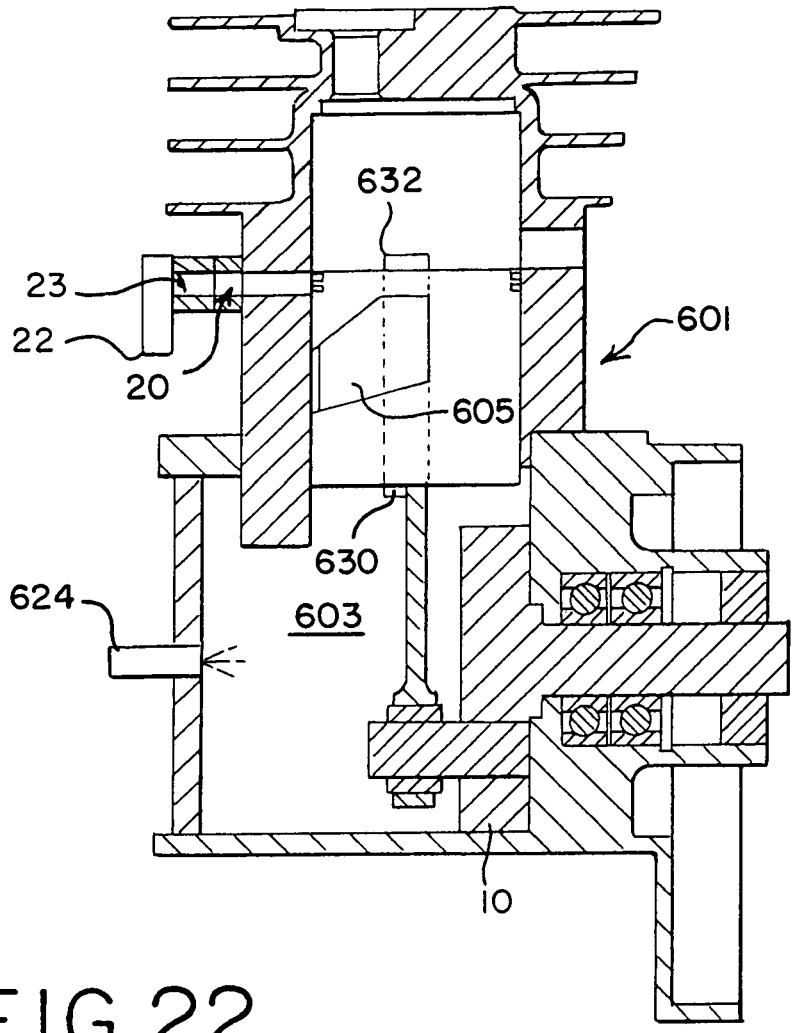
FIG. 21 shows a front cross section view of an embodiment of a two-stroke engine of the present invention having piston ports near BDC.
Figure 22:
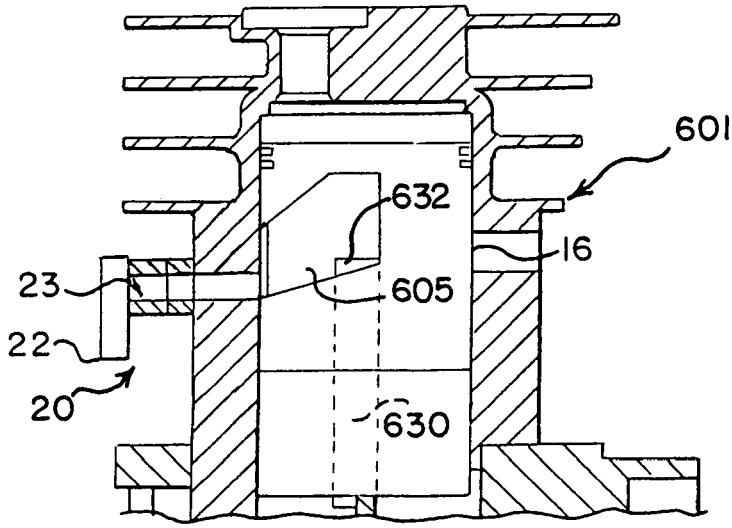
FIG. 22 shows a front cross section view of an embodiment of a two-stroke engine of the present invention having piston ports near TDC.

FIGS. 21-22 illustrate an alternate placement of the fuel injector 624. The fuel injector 624 is positioned in the crankcase 603, allowing for the direct injection of fuel into the crankcase 603. This placement of the fuel injector 624 may improve the stratification of the fuel-free scavenging air in the transfer passages 630 and the fuel-air mixture in the crankcase 603. In operation, the fuel injector 624 injects fuel directly into the crankcase 603. This fuel mixes with air inducted into the crankcase 603 from the transfer passages 630 to form a fuel-air mixture. Other aspects of engine 601 are similar to the engines described above.

Figure 23:
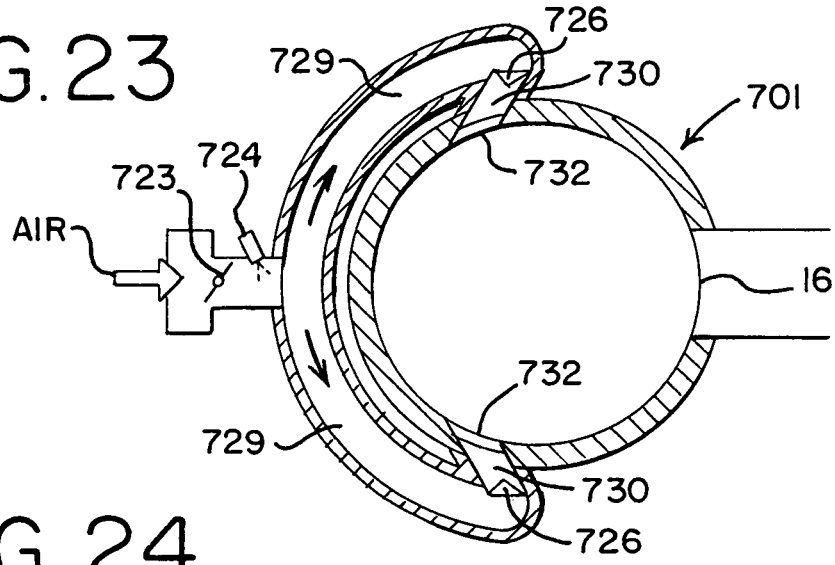
FIG. 23 shows a top cross section view of another embodiment of a two-stroke engine of the present invention.
Figure 24:
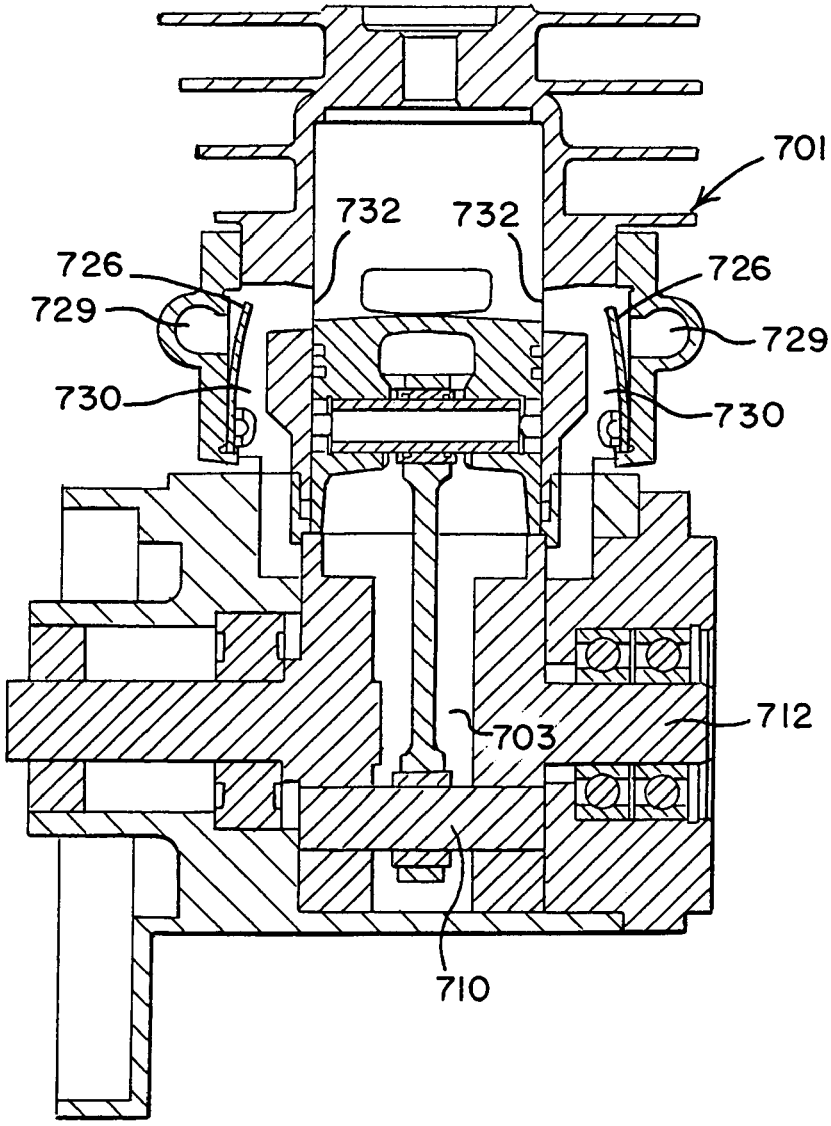
FIG. 24 shows a front cross section view of a full-crank embodiment of a two-stroke engine of the present invention having piston ports near BDC.
Figure 25:
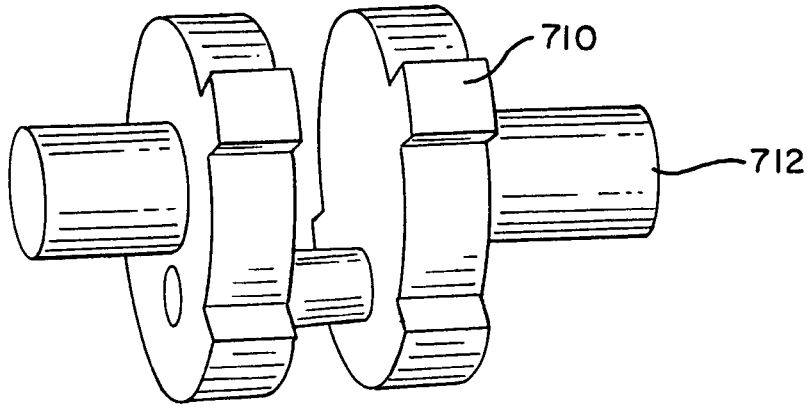
FIG. 25 shows a detail view of the crank web valve of FIGS. 23 and 24.

FIGS. 23-25 illustrate another embodiment of a two-stroke engine 701. The engine 701 is a full-crank engine, being rotatably supported by bearings on both sides of crankshaft 712. Reed valves 726 are positioned at both ends of a second air channel 729, which open into a pair of transfer passages 730. A fuel injector 724 is positioned upstream of the reed valves 726. Moreover, a rotary crank web 710 (best seen in FIG. 25) opens and closes the transfer passages 730 to start and end induction of the fuel-air mixture and air into the transfer passages 730 through the one-way reed valves 726. Once the induction of the fuel-air mixture and air into the transfer passages 730 and crankcase 703 is complete, which generally occurs a few degrees after TDC, the transfer passage 730 is shut-off by the crank web 710. As a result, the air retained in the transfer passage 730 is isolated from the mixture in the crankcase 703. This isolation retains the purity of the air in the transfer passage until the transfer passage 730 once again is opened by the crank web 710 for scavenging process, which can occur slightly before or after the transfer ports 732 are open. Other aspects of engine 701 are similar to the engine 1 shown in FIGS. 1-3 and described above. It should also be noted that the engine 701 of the present invention incorporates components that are similar in design and/or function as those described in U.S. Patent Application No. 2004/0040522, filed May 28, 2003, and entitled Two Stroke Engine With Rotatably Modulated Gas Passage. The contents of this patent are hereby incorporated by reference to avoid the unnecessary duplication of the description of these similar components. A detailed description of the operation of the rotary crank web 710 may also be found in the 2004/040522 Application.

Figure 9A:
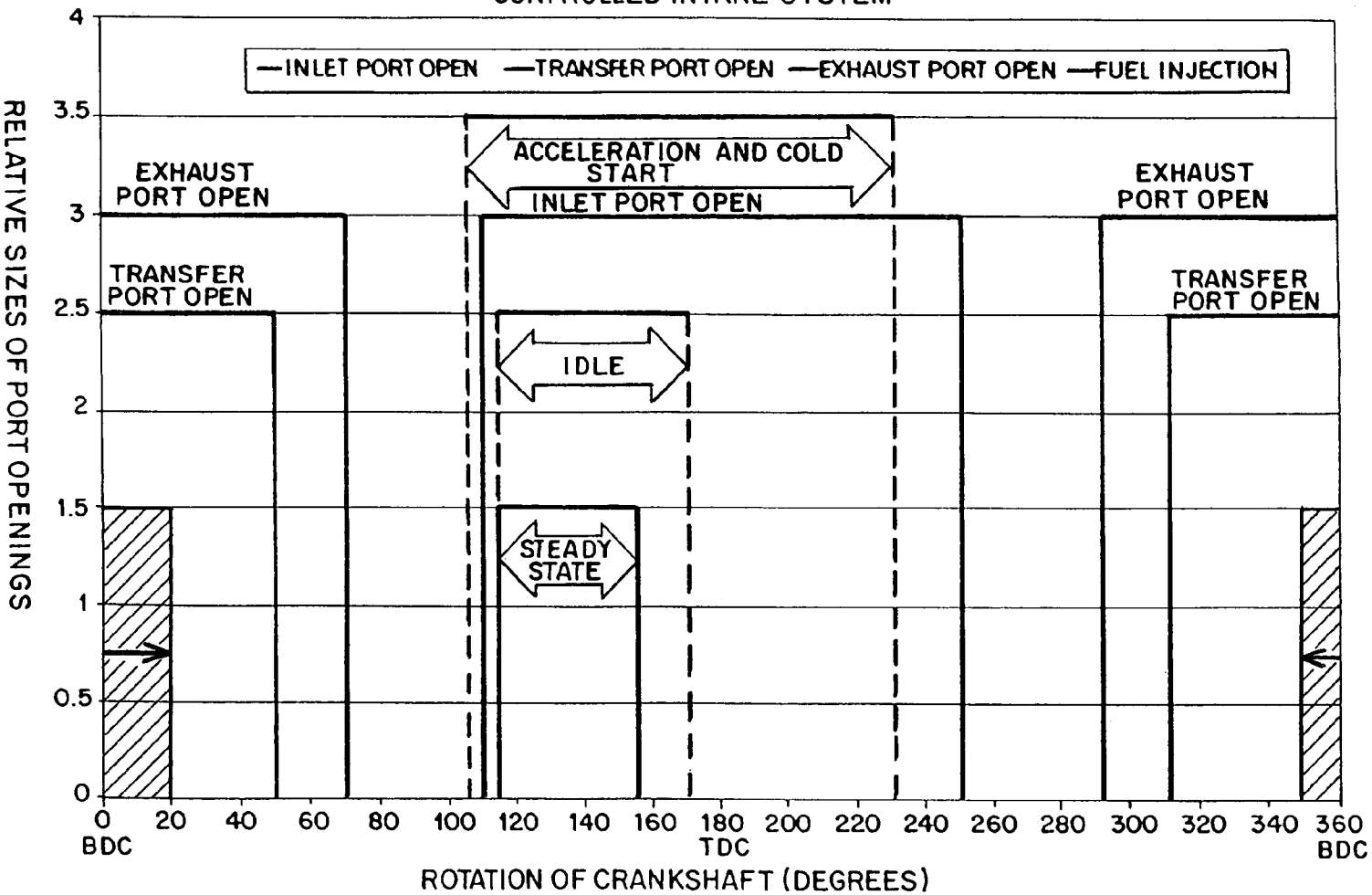
FIG. 9A shows a timing diagram for a two-stroke engine having a piston port and rotary valve controlled intake system where the fuel injector is located down stream of the reed valves or when fuel is injected directly into the transfer passage or near transfer ports.
Figure 26:
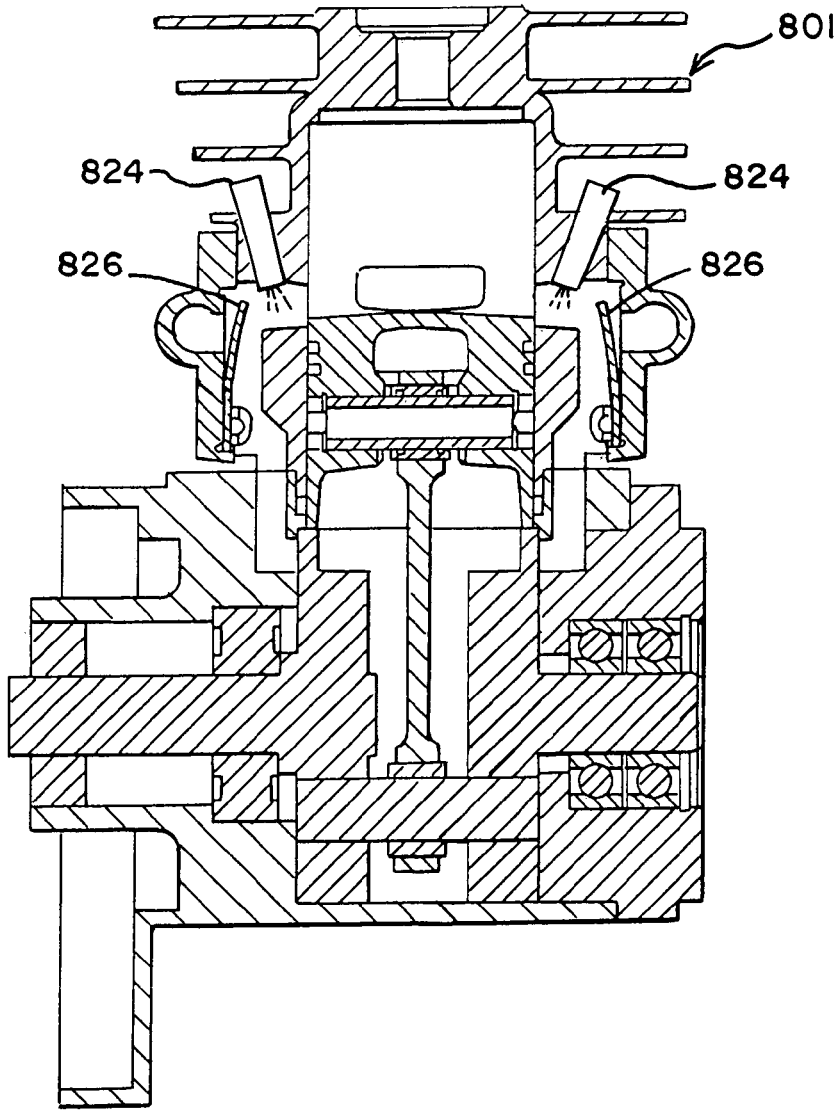
FIG. 26 shows a front cross section view of a full-crank embodiment of a two-stroke engine of the present invention having piston ports near BDC.
Figure 27:
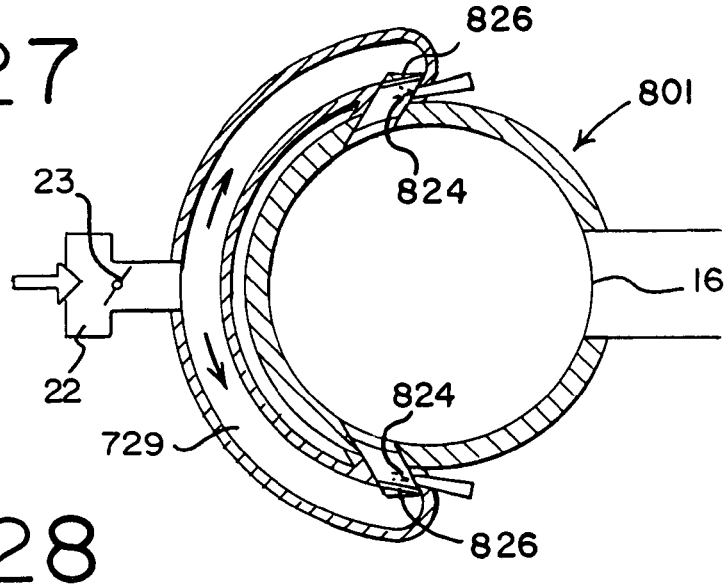
FIG. 27 shows a top cross section view of another embodiment of a two-stroke engine of the present invention.

Another embodiment of a two-stroke engine 801 is illustrated in FIGS. 26-27. A pair of fuel injectors 824 are positioned downstream of one-way reed valves 826. By using two injectors 824, the injector size may be reduced in larger engines. This would allow the operation of only one injector during low load or idle conditions. Also, for pulse injection systems, by positioning the injectors downstream of the one-way reed valves and located to inject directly into the transfer passage or near the transfer port, a small fraction of fuel may be injected into the stream of lean fuel-air mixture during the late part of the scavenging process. As a result, the stratification of the mixture is enhanced, such that substantially fuel-free air flows first into the combustion chamber, followed by a pre-mixed lean mixture that was mixed during the induction process and in the crankcase, and followed last by the rich mixture. As a result, the fuel economy is maximized while the emissions are minimized. FIG. 9*a* illustrates the fuel injection sequence when the injector is located down stream of the reed valves or when fuel is injected directly into the transfer passage or near transfer ports. The hatched area shows that fuel is injected late during scavenging process also. Other aspects of engine 801 are similar to the engine 701 shown in FIGS. 23-25 and described above.

Figure 28:
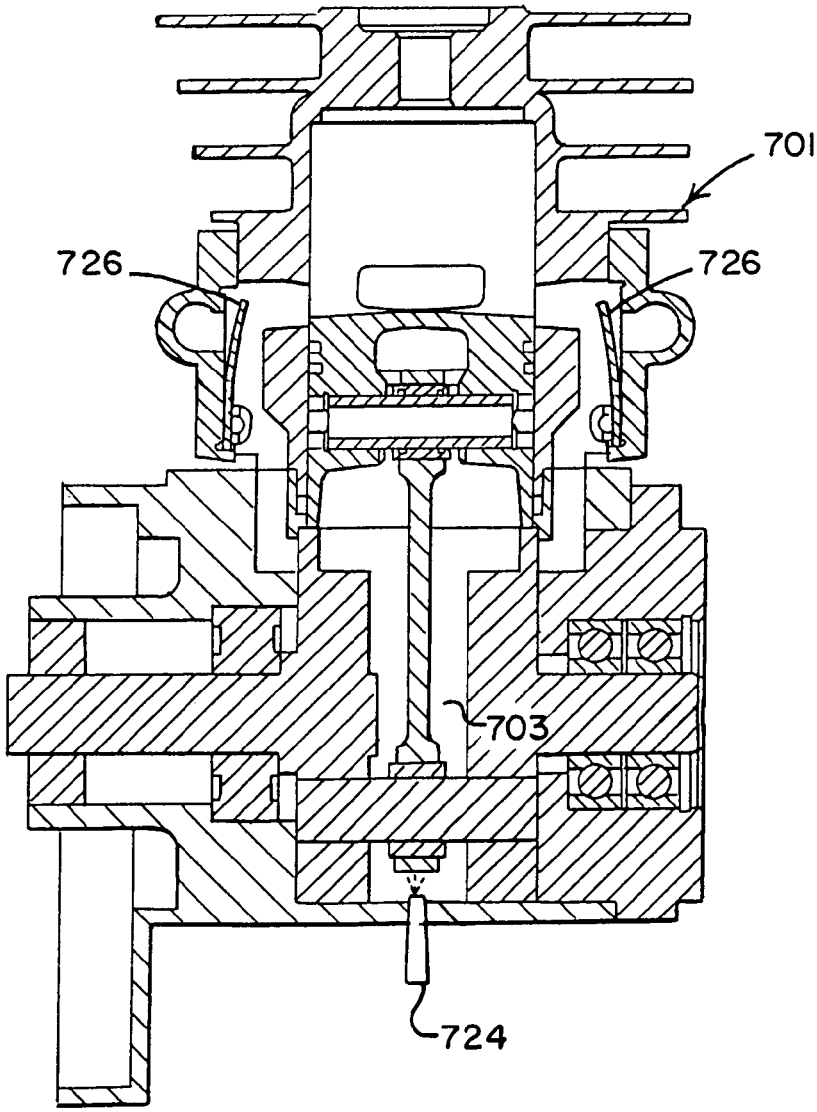
FIG. 28 shows a front cross section view of another embodiment of a two-stroke engine of the present invention.

FIG. 28 illustrates the two-stroke engine 701 where the fuel injector 724 is repositioned to inject fuel directly into the crankcase 703. As described above, this placement of fuel injector 724 may improve the stratification of the fuel-free scavenging air in the transfer passages 730 and the fuel-air mixture in the crankcase 703.

Figure 30:
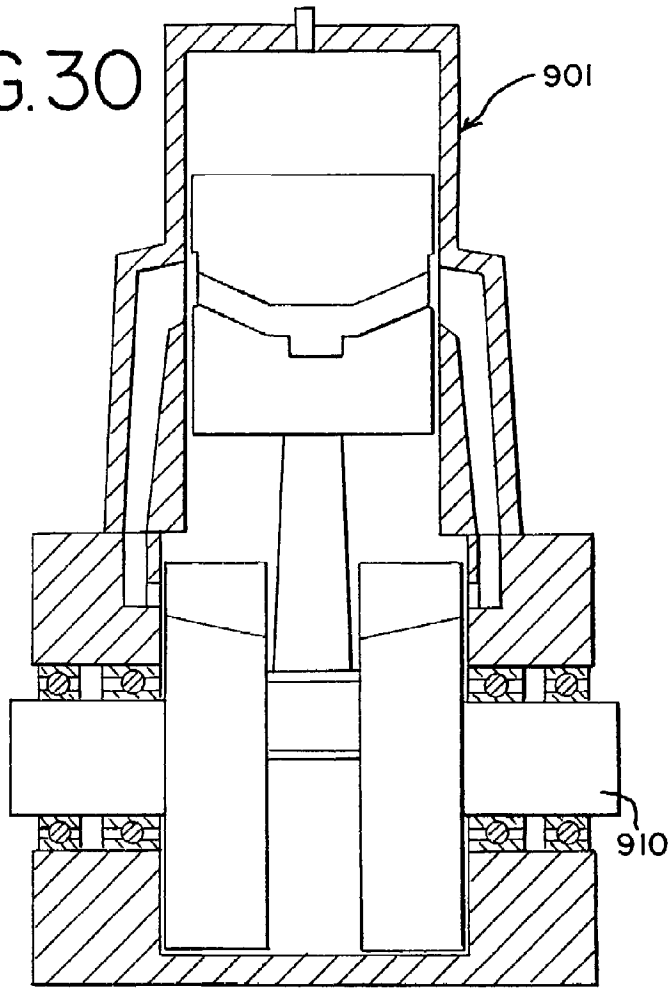
FIG. 30 shows a front cross section view of another embodiment of a full-crank two-stroke engine of the present invention.
Figure 29:
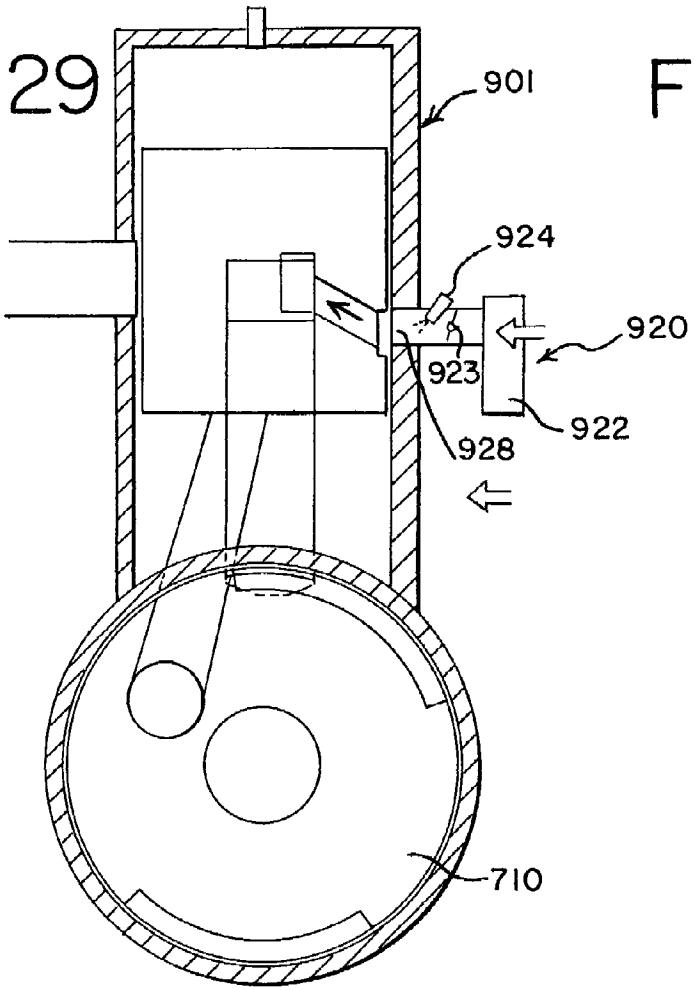
FIG. 29 shows a side cross section view of another embodiment of a full-crank two-stroke engine of the present invention.

FIGS. 29-30 illustrate a full-crank piston-ported two-stroke engine 901. A crank web valve 710, illustrated in FIG. 25 and described in U.S. Patent Application No. 2004/0040522, filed May 28, 2003, and entitled Two Stroke Engine With Rotatably Modulated Gas Passage, controls the timings of opening and closing of transfer passages and thus the scavenging processes. The fuel injector 924 is located at the inlet port 928. Other aspects of engine 901 are similar to the engines described above. In addition, the crank web valve 710 may be used in any of the engines 1, 101, 201, 301, 401, 501, 601, 701, 801, 901 described above. The crank web valve 710 may be used along with the reed valves or piston porting. Moreover, the crank web valve reduces the mixing that may occur between the stratified pure air in the transfer channels and the fuel-air mixture in the crankcase.

Figure 31:
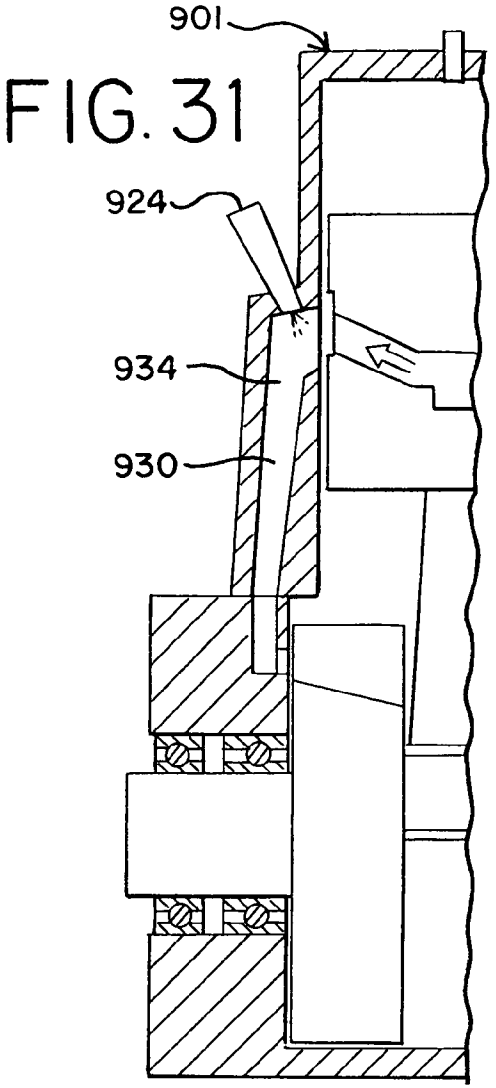
FIG. 31 shows a front cross section view of another embodiment of a full-crank two-stroke engine of the present invention.

FIG. 31 illustrates the full-crank engine 901 wherein the fuel injectors 924 are positioned at the top portion 934 of the transfer passages 930. As described above for engine 801, by using two injectors 924, the injector size may be reduced in larger engines. This would allow the operation of only injector during low load or idle conditions. In addition, a small fraction of fuel may be injected into the stream of lean fuel-air mixture during the late part of the scavenging process.

Figure 32:
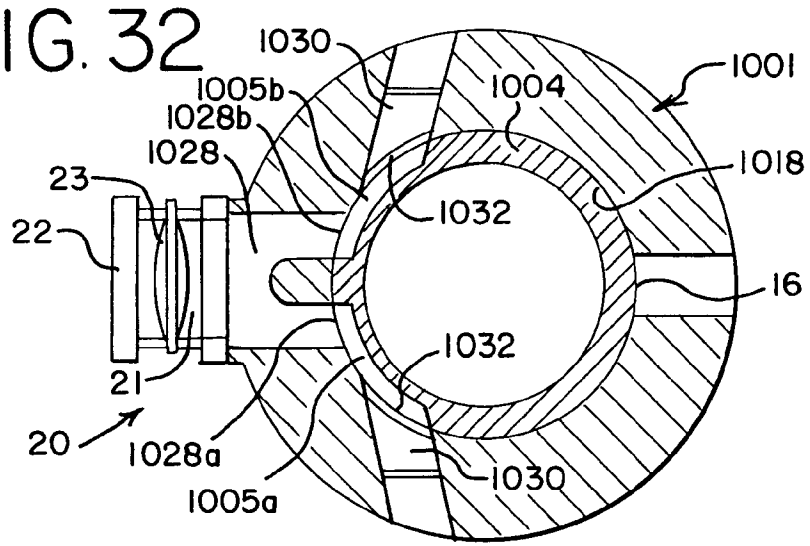
FIG. 32 shows a top section view of another embodiment of a two-stroke engine of the present invention.

FIG. 32 illustrates a two-stroke engine 1001. The inlet port 1028 is split into a first half 1028*a* and a second half 1028*b*. These halves 1028*a* and 1028*b* connect to transfer ports 1032. By splitting the inlet port 1028, halves 1028*a* and 1028*b* may be positioned closer to transfer ports 1032 and provide air to a pair of transfer passages 1030. In addition, the engine 1001 and the piston 1004 may be cast easier. Other aspects of engine 1001 are similar to the engine 501 shown in FIGS. 18-20 and described above.

Figure 33:
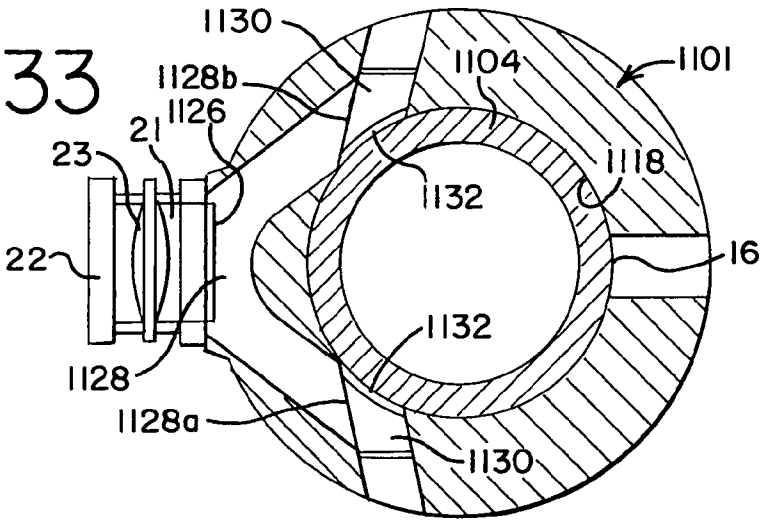
FIG. 33 shows a top section view of another embodiment of a two-stroke engine of the present invention.

FIG. 33 illustrates a two-stroke engine 1101. The inlet port 1128 is split into a first half 1128*a* and a second half 1128*b*. The reed valve 1126 permits air to pass to the first half 1128*a* and a second half 1128*b* of the inlet port 1128. These halves 1128*a* and 1128*b* connect to transfer ports 1132. By splitting the inlet port 1128, halves 1128*a* and 1128*b* and transfer ports 1132 may be positioned on either side of the exhaust port 16, allowing for loop scavenging. Other aspects of engine 1101 are similar to the engine 1 shown in FIGS. 1-2 and described above.

Figure 34:
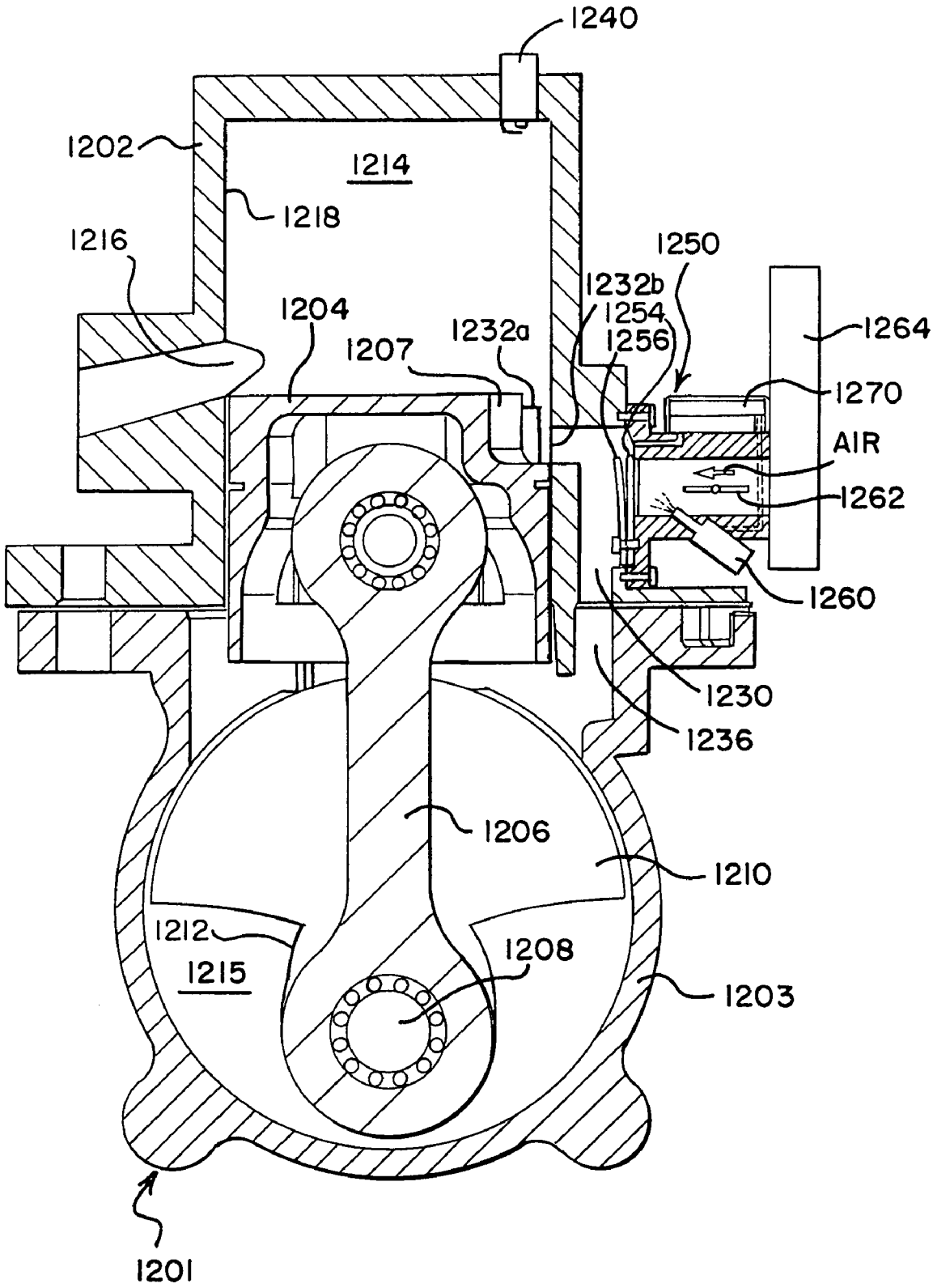
FIG. 34 shows a side cross section of another embodiment of a two-stroke engine of the present invention.

FIG. 34 illustrates another embodiment of a two-stroke engine 1201. The engine 1201 includes a cylinder 1202 and a crankcase 1203. A crankcase chamber 1215 is defined inside of crankcase 1203. A piston 1204 is reciprocally mounted within the cylinder 1202 and is connected by a connecting rod 1206 to a crank throw 1208 on a circular crank web 1210 of a crankshaft 1212. The piston 1204 is provided with a hollow 1207 formed in the upper surface. This hollow 1207 is located opposite a spark plug 1240 mounted in the upper surface of the cylinder 1202. Hollow 1207 and spark plug 1240 may be located off-center from the centerline of the piston 1204 and cylinder 1202.

A combustion chamber 1214 is formed in the cylinder 1202 and is delimited by the piston 1204. One end of the crankshaft 1212 includes the crank web 1210 for weight compensation and rotational balancing. The combustion chamber 1214 is connected through an exhaust port 1216 formed in the cylinder wall 1218 to an exhaust gas-muffler or similar exhaust-gas discharging unit (not shown). The exhaust port 1216 permits exhaust gas to flow out of the combustion chamber 1214 and into the exhaust gas-muffler. Piston hollow 1207 is formed to direct the flow of charge upward to keep the charge from directly flowing into the exhaust port 1216.

The engine 1201 includes a scavenging system with at least one transfer passage 1230 establishing gaseous communication between the crankcase chamber 1215 and the combustion chamber 1214. The transfer passage 1230 is used for scavenging and allowing a fresh fuel-air charge to be drawn from the crankcase 1203 into the combustion chamber 1214 through a transfer port 1232 in the cylinder wall 1218 at the completion of a power stroke.

An intake system 1250 supplies the scavenging air and the fuel-air charge necessary to operate the engine 1201. The intake system 1250 includes a reed valve having a reed petal 1254 and a reed plate 1256, a fuel injector 1260, a throttle valve 1262, and an air filter 1264. The intake system 1250 is mounted to the cylinder 1202, forming a cover for the transfer passage 1230.

In operation, as the piston 1204 moves upward to TDC, the crankcase 1203 pressure drops. This pressure drop inducts air into the transfer passage 1230 through the reed petal 1254 and into the crankcase 1203 through a passage 1236 at the bottom of transfer passage 1230. As shown in the timing diagram illustrated in FIG. 35, the fuel injector 1260 injects fuel into the air, forming a fuel-air mixture. In this reed-valve controlled intake system, the pressure difference across the reed petal 1254 of reed valve determines the intake duration, while the throttle valve 1262 controls the amount of air flowing into the engine. The duration of fuel injection determines the stratification. In a steady state operating condition, the fuel injection ends well before the induction of air ends. As a result of ending the fuel early, only air continues to flow into the transfer passage 1230. As a result, air sits in-situ between the transfer port 1230 and the crankcase chamber 1215. Therefore, only substantially fuel-free air is filled in the transfer passage 1230.

The start and end of the injection of fuel into the intake air stream is dependent on the engine operating condition. For example, at cold start, it may be desirable to start the injection early and also end late, thus not having any stratification at all. During idling and warm up, the stratification may be achieved gradually as the engine warms up. During acceleration, the injection may start slightly sooner than the inlet timing and continue well past the end of injection for steady state, but before end of induction. As a result, while providing an extra rich mixture for acceleration, it may be possible to achieve stratification for improved emission. Also, stratification during idling may lower emission levels.

Figure 35:
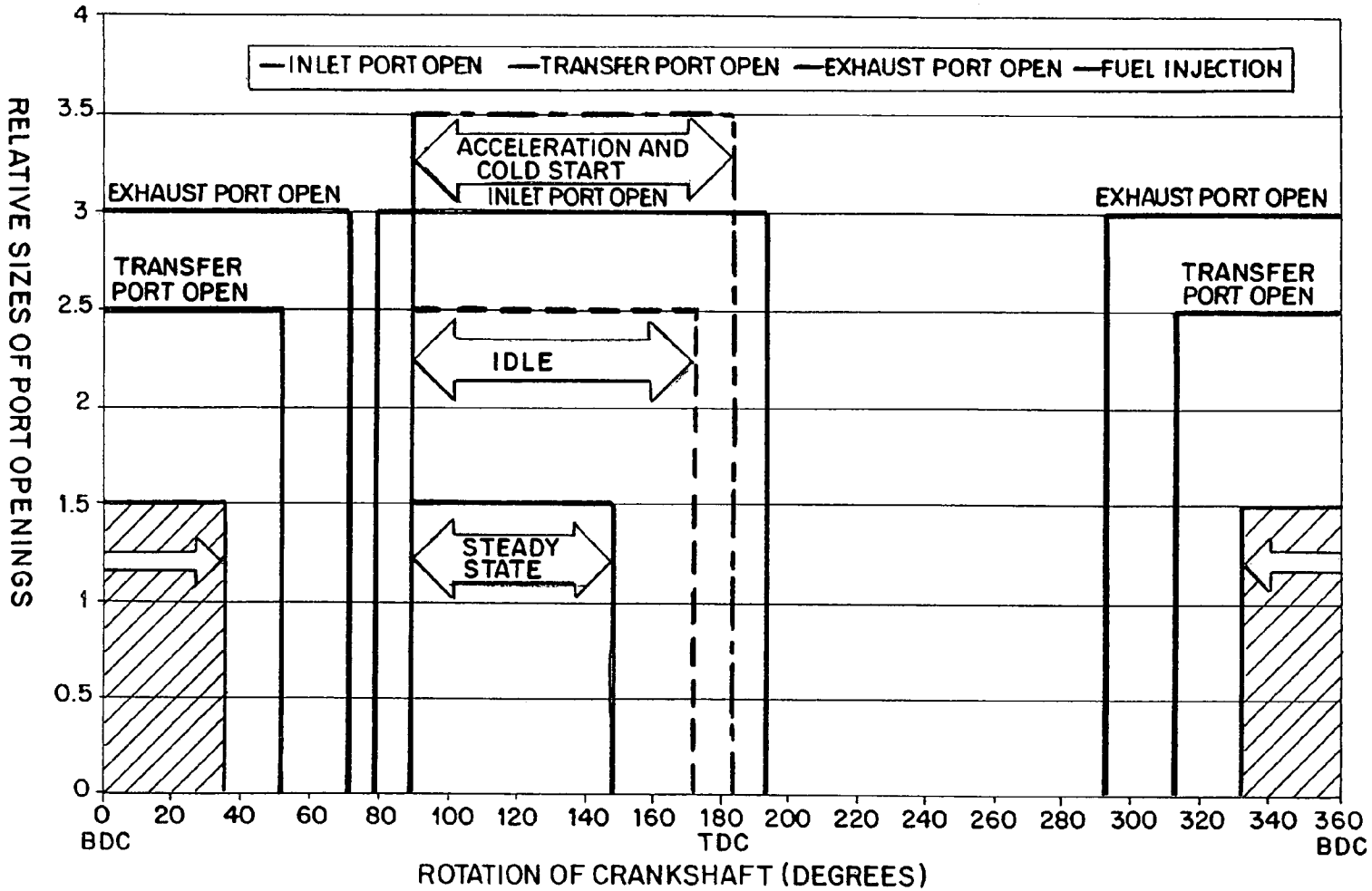
FIG. 35 shows a timing diagram for a two-stroke engine having a reed valve controlled intake system as in the engine shown in FIG. 34.

The timing plot illustrated in FIG. 35, which is similar to FIG. 3, shows the approximate port timings for the reed-valved engine 1201. The duration of fuel injection shown in the plot explains when the fuel is cut-off, after which time only air flows in to the transfer passage. Also, it may be possible to completely cut off fuel during deceleration.

Figure 36:
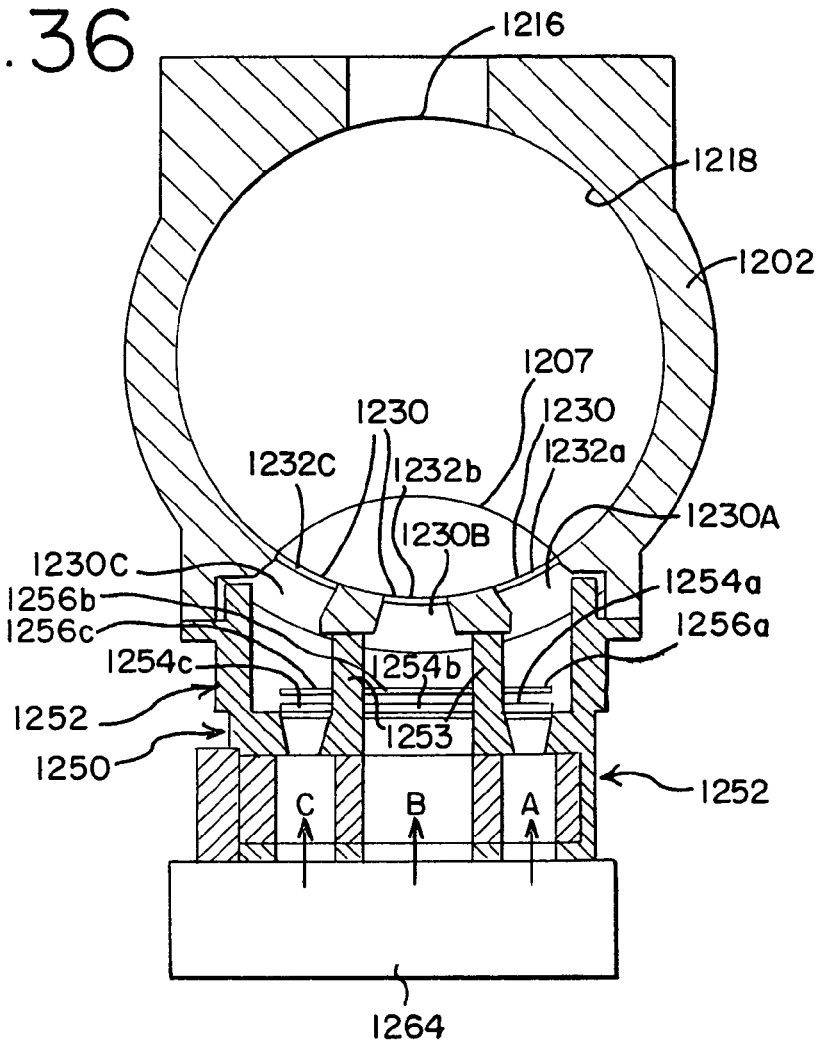
FIG. 36 shows a detail view of an intake manifold of an embodiment of a two-stroke engine of the present invention.

The intake system 1250 may also include a multi-barrel intake manifold 1252, as illustrated in FIG. 36. The intake manifold 1252 may separate the transfer passage 1230 into multiple passages 1230*a* 1230*b* 1230*c* through a plurality of ribs 1253. Such a multi-barrel intake system allows for regulating the air supply to individual transfer passages separately. While FIG. 36 illustrates manifold 1252 as having two ribs 1253 dividing the transfer passage 1230 into three passages 1230*a* 1230*b* 1230*c*, other numbers of ribs 1253 may be used to divide the transfer passage 1230 into other numbers of passages.

Figure 37:
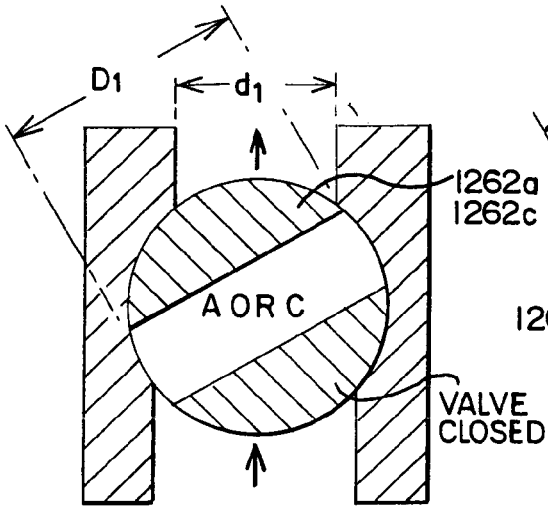
FIG. 37 shows a detail view of an intake manifold of a two-stroke engine of the present invention.
Figure 38:
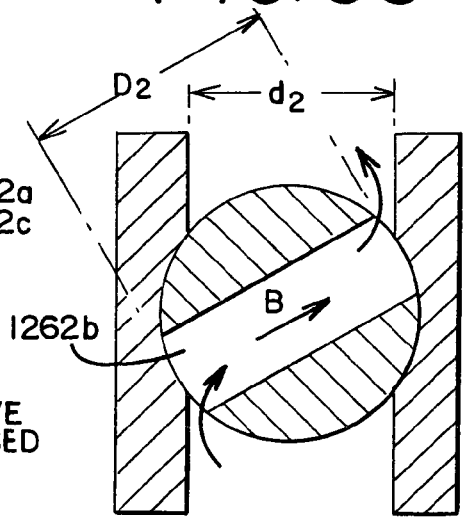
FIG. 38 shows a detail view of an intake manifold of a two-stroke engine of the present invention.

The intake manifold 1252 may also integrate the reed valve into one assembly. As seen in FIGS. 36-38, the air supply to individual transfer passages 1230*a* 1230*b* 1230*c* is regulated separately through the valves 1262*a* 1262*b* 1262*c*, respectively. These valves may be rotary throttle control valves, and are illustrated in FIGS. 37-38. The fuel injector 1260 provides fuel only to the middle passage 1230*b*. Also, the size of the inlet opening or throat does not have to be the same for each of the three passages 1230*a* 1230*b* 1230*c*. The inlet to the outside passages 1230*a* and 1230*c* are closed at idle and part throttle allowing more air into the middle passage 1230*b*. The fuel is injected (the fuel injector is not shown) into this stream of air. FIGS. 37 and 38 illustrate the outside valves 1262*a* 1262*c* and middle valve 1262*b*, respectively. At higher throttle, all three valves 1262*a* 1262*b* 1262*c* may be open. The size of the throat diameters d1 and d2 in relation to barrel diameters D1 and D2 is shown in FIGS. 37 and 38, with D1 being relatively larger than d1.

Further, because fuel is more or less constrained to flow through the middle passage 1230*b*, the air flow through the adjacent passages acts as an envelope of air for the fuel delivery into the combustion chamber. By staggering the transfer ports in such a way that the middle transfer port 1232*b* opens later than the side transfer ports 1232*a* and 1232*c* as the piston travels downward, air is allowed to enter the combustion chamber 1214 through the side transfer ports 1232*a* and 1232*c* before the fuel-air mixture enters the combustion chamber 1214 through the middle transfer port 1232*b*. Therefore, only substantially fuel-free air will be lost into the exhaust. Emissions may also be lower at idle and part throttle. This is shown in FIG. 34 where the opening of the side transfer port 1232*a* is positioned higher on the cylinder wall 1218 than the middle transfer port 1232*b*.

For engine 1201 seen in FIG. 34 with the multi-barrel manifold 1252 described above, the fuel injection can be timed to achieve ideal mixing of fuel and air. Also, since the fuel is injected early during intake, it goes into the crankcase 1203 for lubrication. Moreover, the churning of air and fuel in crankcase 1203 aids in mixing.

Figure 39:
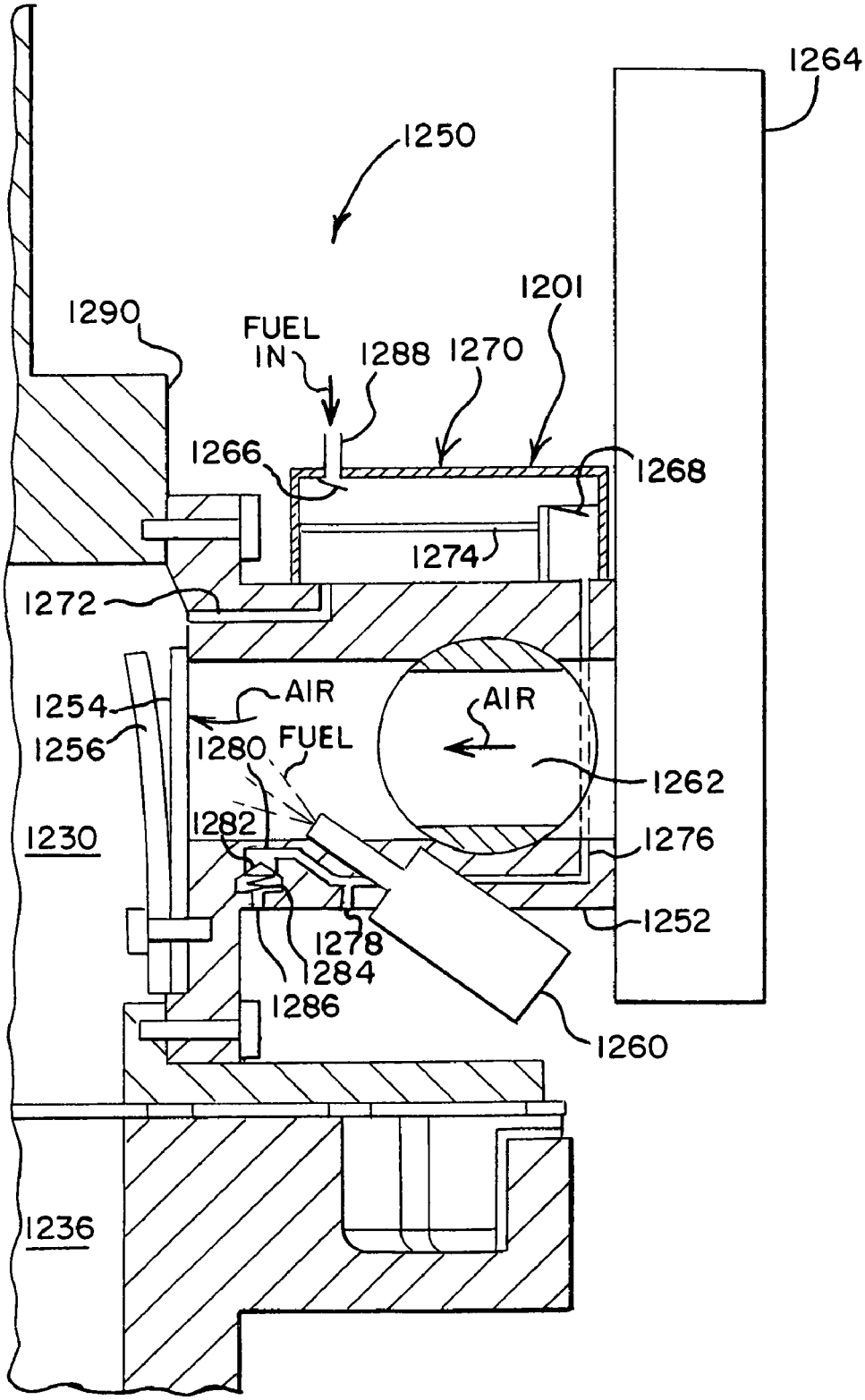
FIG. 39 shows a side cross section detail view of an intake manifold of a two-stroke engine of the present invention.

FIG. 39 illustrates the engine 1201, described above, with an integral fuel pump with the intake manifold 1252, which also houses the reed petals 1254*a* 1254*b* 1254*c* (only 1254*b* is shown in FIG. 39; 1254*a* and 1254*c* are shown in FIG. 36). The intake system 1250 is connected to the block 1290 of the two-stroke engine. In general, this embodiment of intake manifold 1252 may also be used in any of the other piston ported engines described herein in addition to the engine shown in FIG. 39.

The fuel pump 1270 operates similar to a pump in a carburetor, requiring a pulsating pressure signal from the crankcase 1203 (as seen in FIG. 34). For example, as shown in FIG. 39, a passageway 1272 may be provided between the transfer passage 1230 and a diaphragm 1274. As a result, when the piston rises, a pressure drop occurs in the transfer passage 1230 and the diaphragm passageway 1272. This causes the diaphragm 1274 to deflect away from the fuel inlet 1288 of the fuel pump 1270. The resulting negative pressure above the diaphragm 1274 causes the inlet flapper valve 1266 to open, and fuel is drawn into the fuel pump 1270. However, when the piston moves downward, a pressure rise occurs in the transfer passage 1230 and the diaphragm passageway 1272. This causes the diaphragm 1274 to deflect toward the fuel inlet 1288. The resulting positive pressure forces the inlet flapper valve 1266 closed and causes the fuel injector flapper valve 1268 to open. As a result, fuel is pumped into the fuel injector line 1276. Actual arrangement of the pump 1270 and the flapper valves 1266 and 1268 is similar to standard diaphragm carburetors, for example, ZAMA's H60E model and WALBRO's WYC 10.

The fuel injector line 1276 is routed to the fuel injector inlet (shown and described below), thereby supplying fuel to the fuel injector 1260. The fuel injector line 1276 may also be routed to a purge line 1278 if desired. The purge line 1278 may be connected to a purge bulb (e.g., a device with a one-way valve or other flow control device) to enable an operator to manually purge the fuel system of air. The fuel injector line 1276 may also be routed to a pressure regulator to control the fuel pressure to the fuel injector 1260. Preferably, the pressure regulator has a pressure chamber 1280 connected to the fuel injector line 1276. A pressure regulator valve 1282 is positioned within the pressure chamber 1280. The pressure regulator valve 1282 may be cone shaped as shown or any other shape adapted to control fluid flow. The pressure regulator valve 1282 is biased forward by a spring 1284 so that a forward surface of the valve 1282 seals against a circumferential surface of the pressure chamber 1280. As a result, when the fuel pressure in the fuel injector line 1276 exceeds a predetermined threshold, the fuel pressure forces the pressure regulator valve 1282 rearward against the spring 1284. This unseals the valve 1282 and allows fuel to flow to the pressure regulator outlet 1286, where it is routed back to the fuel reservoir.

As described above, the rotary throttle valve 1262 controls air flow into the intake system 1250. The rotary throttle valve 1262 may be a barrel valve 1262 as shown in FIG. 39 or may be a butterfly valve 1262 as shown in FIG. 34 or any other type of rotary throttle valve. The fuel injector 1260 injects fuel into the air flow as described above and further below. Preferably, an electronic control unit is used to control the fuel injector 1260. Passage of the fuel-air mixture into the transfer passage 1230 is controlled by the reed petal 1254*b*. Thus, when the piston rises, the resulting pressure drop across the reed valve causes the reed petal 1254 to open, and the fuel-air mixture is drawn into the transfer passage 1230. When the piston moves downward, the resulting pressure rise causes the reed petal 1254 to close and seal, thereby preventing further fuel-air mixture from flowing into the transfer passage 1230.

Figure 40:
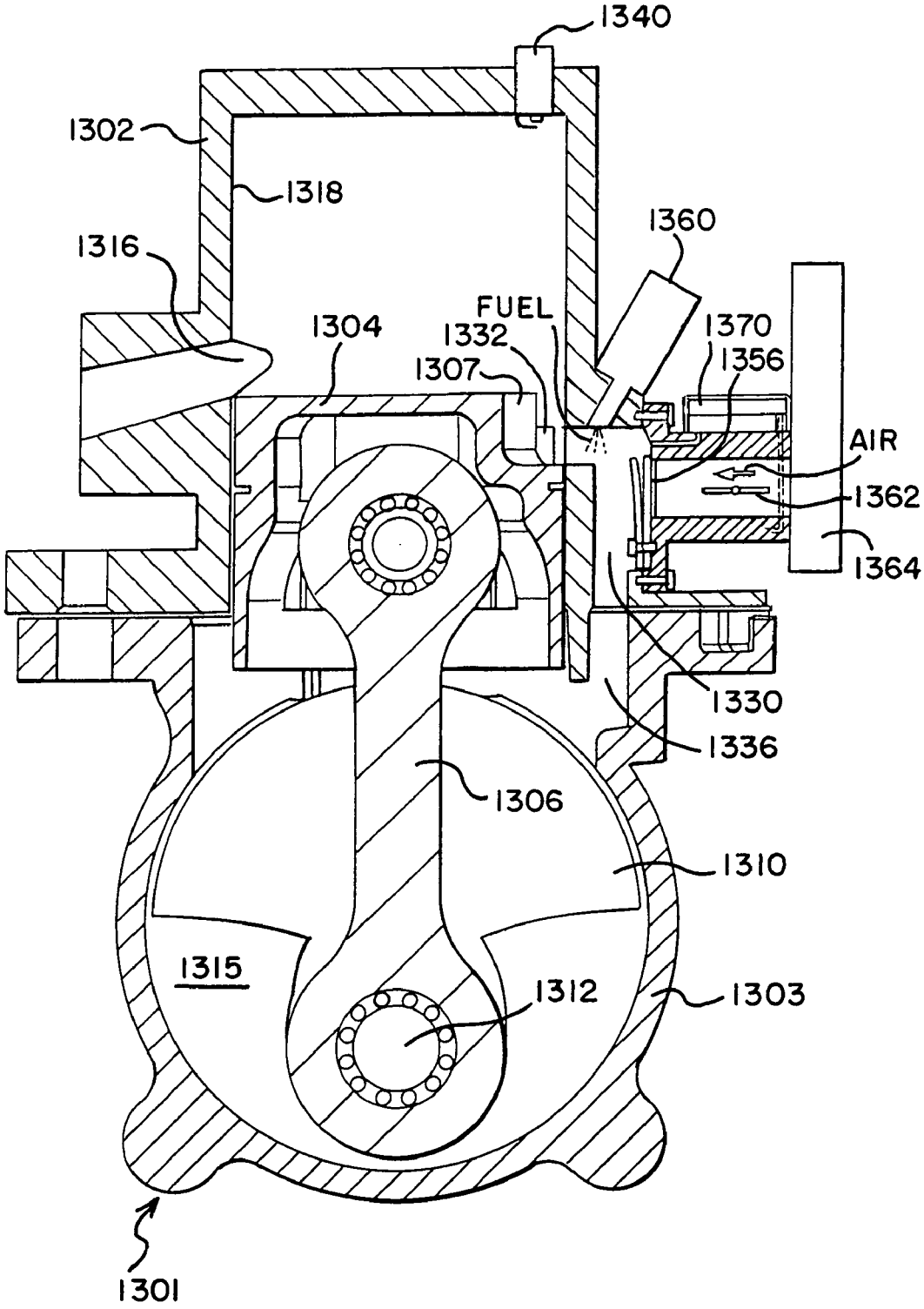
FIG. 40 shows a side cross section of another embodiment of a two-stroke engine of the present invention.

FIG. 40 illustrates engine 1301 where the fuel injector 1360 is positioned to inject fuel directly into the transfer passage 1330. The fuel may be injected in two phases. In the first phase, the fuel is injected early during the induction, so that fuel gets into the crankcase 1303 for lubrication. In the second phase, fuel is also injected during the late scavenging process, where charge flows from crankcase into combustion chamber. This results in a scavenging process where air is followed by lean mixture and then followed by rich mixture. Other aspects of engine 1301 are similar to the engines described above.

One type of fuel injector 1400 which may be used with the engines described above is shown in FIG. 41. The fuel injector 1400 is preferably designed to operate at low pressure and consume low power. An example of this type of fuel injector is provided by Lee Company as a control valve for fluid controls. For additional details on control valves from Lee Company, Lee Company's Technical Handbook, release 7.1 may be referred to.

The fuel injector 1400 has a valve body 1402 that houses the components of the fuel injector 1400 and may be connected to the intake system at the location where fuel injection is desired. Fuel enters the fuel injector 1400 through an inlet 1404 and fills a chamber 1406. A spring 1408 is positioned behind a portion of the plunger 1410 and biases the plunger 1410 forward. A seal 1412 is provided at the forward end of the plunger 1410. As a result, the spring 1408 causes the front seal 1412 of the plunger 1410 to seal against the outlet passage 1414.

Operation of the fuel injector 1400 is controlled by an electronic control unit ("ECU") 1416. The ECU 1416 produces electrical signals representative of the fuel injection examples described above. The electrical signals are transmitted to the fuel injector 1400 through an electrical terminal 1418. The electrical signals from the ECU 1416 activate and deactivate an electromagnetic coil 1420 in the fuel injector 1400 to control the duration and timing of the fuel which passes through the injector outlet 1422. For example, the electromagnetic coil 1420 may be activated by the ECU 1416 to force the plunger 1410 rearward against the spring 1408. This opens communication between the inlet 1404 and the outlet 1422 by moving the front seal 1412 away from the outlet passage 1414. A rear seal 1424 may also be provided behind a portion of the plunger 1410 to seal the rearward portion of the chamber 1406 when the outlet 1422 is opened to the inlet 1404. When the electro-magnetic coil 1420 is deactivated by the ECU 1416, the spring 1408 forces the plunger 1410 forward until the front seal 1412 closes the outlet passage 1414.

A return port 1426 may also be provided. When the plunger 1410 is forced forward by the spring 1408 so that the front seal 1412 closes the outlet passage 1414, fuel may pass through the chamber 1406 and a coaxial passageway 1428 to the return port 1426. When the plunger 1410 is forced rearward by the electromagnetic coil 1420 so that the rear seal 1424 closes the coaxial passageway 1428, fuel flow between the inlet 1404 and the return port 1426 is blocked. The return port 1426 is optional and may be eliminated if desired. However, the return port 1426 is preferred because it cools the fuel injector 1400 and helps to prevent air locks in the fuel system. The return port 1426 may also be connected to a purge valve to improve starting performance.

Figure 41:
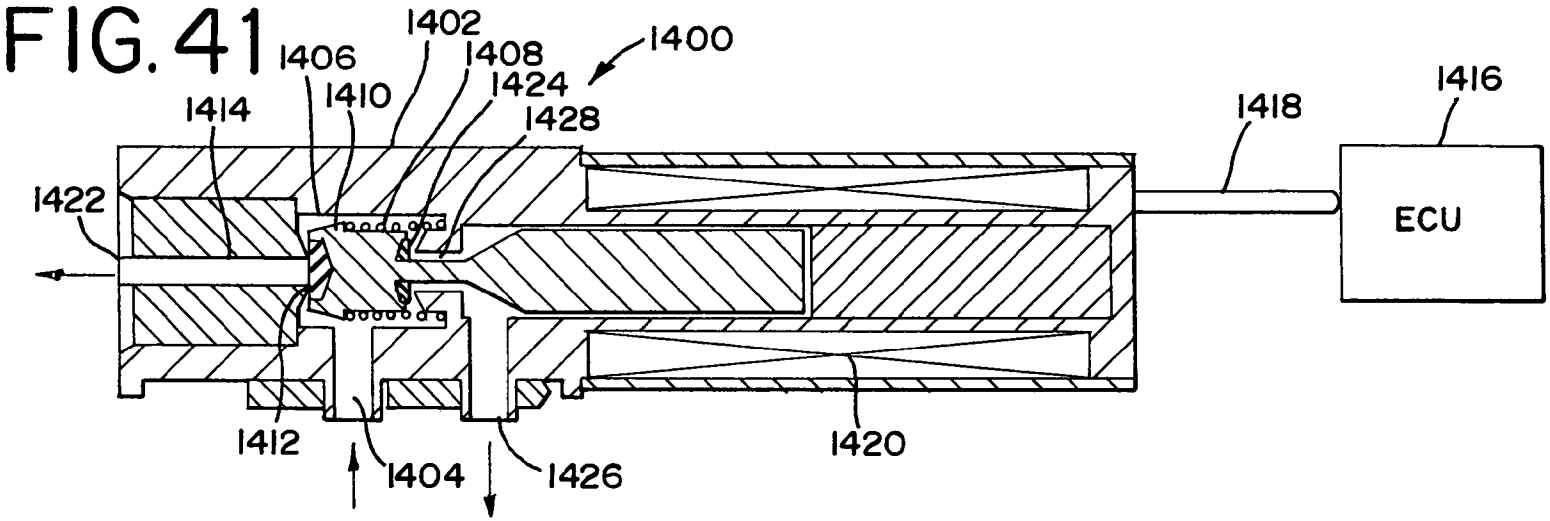
FIG. 41 shows a side cross section of a fuel injector that may be used in the present invention.

An advantage of the fuel injector 1400 shown in FIG. 41 is that it may be used with low cost, low pressure fuel pumps, such as the diaphragm pump 1270 shown in FIG. 39. For example, the fuel injector may be used with an operating pressure up to 1 to 10 psig. The fuel injector also has low power consumption. Typically, the power consumption may be about 250 to 550 miliwatts. The fuel injector also has long life and may operate more than 300 hours.

Figure 42:
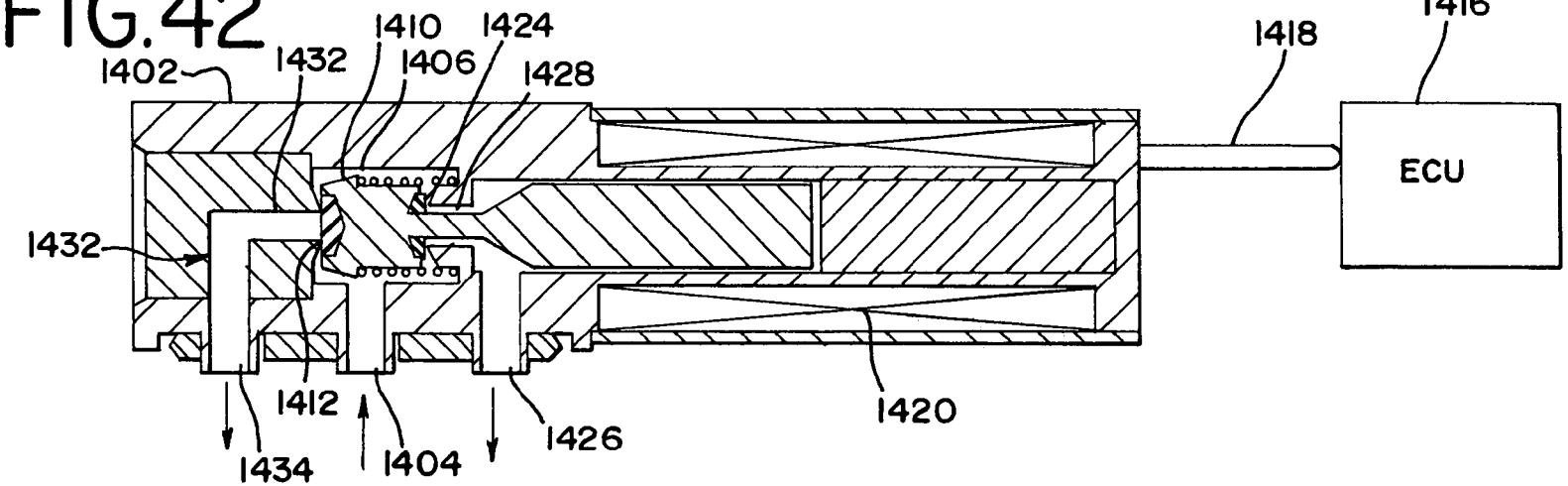
FIG. 42 shows a side cross section of another fuel injector that may be used in the present invention.

An alternative fuel injector 1430 is shown in FIG. 42. Most of the components of this fuel injector 1430 are the same as the fuel injector 1400 described above and shown in FIG. 41. Thus, it is unnecessary to repeat the full description. One difference with this fuel injector 1430 is that the outlet passage 1432 is angled so that the outlet 1434 is parallel with the inlet 1404 and the return port 1426. This may be advantageous in order to mount the fuel injector 1430 flush against the fuel intake system.

It will be appreciated that the above illustrated and described two-stroke engine provides a novel air and fuel intake configuration which may be used for improved scavenging and stratification. The two-stroke engine is particularly well suited for driving a flexible line trimmer for cutting vegetation, but it may also be used for a brush cutter having a rigid blade, or a lawn edger. The rotary engine incorporating such a fuel injection system may also be used for driving a hedge trimmer, vacuum, blower, snow blower, power hacksaw, circular saw, chain saw, water pump, lawn mower, generator or other hand-held power tools, for example.

Figure 43:
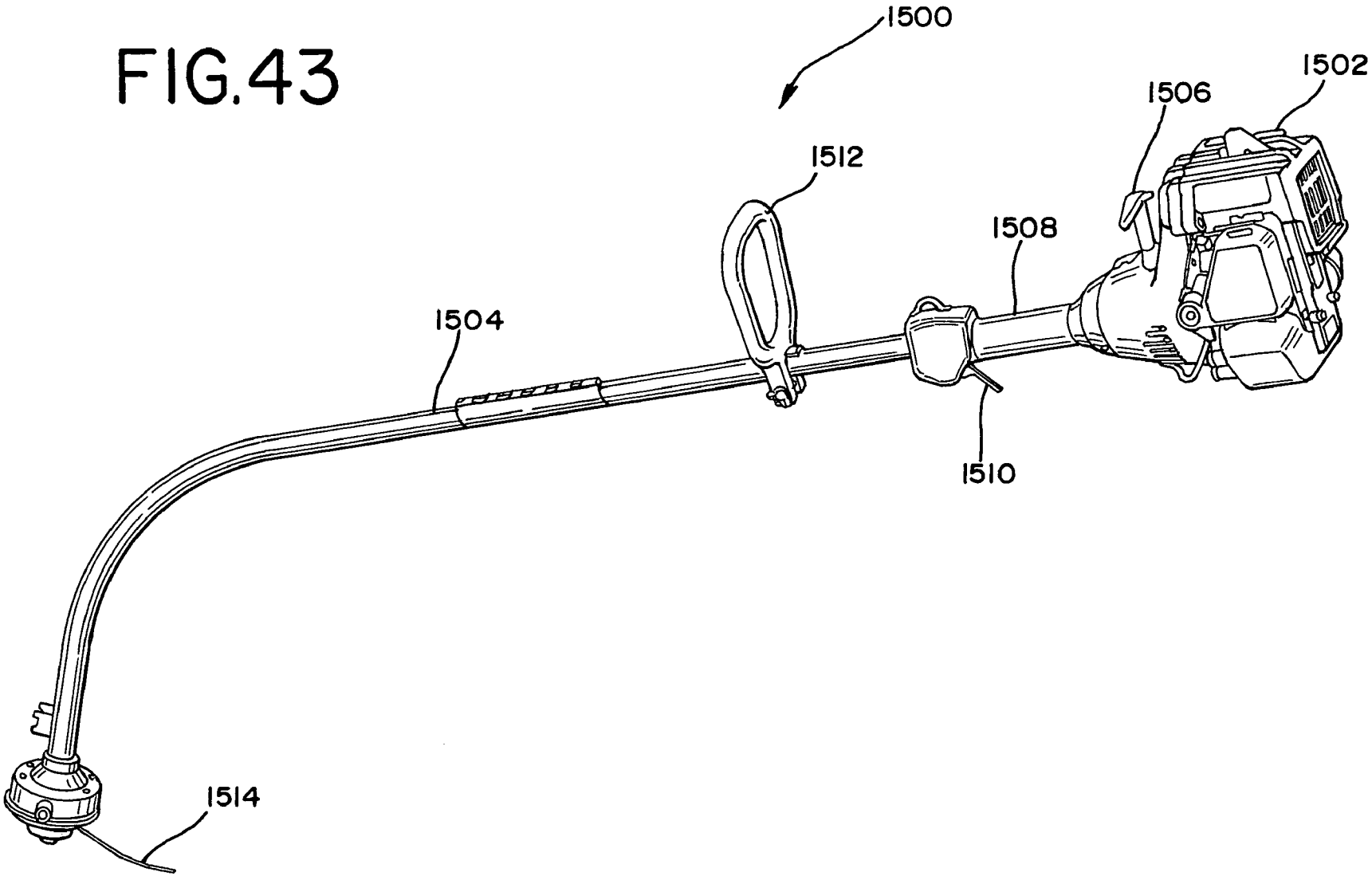
FIG. 43 shows a lawn and garden, hand-held trimmer that may be used in the present invention.

As shown in FIG. 43, the two-stroke engine may be used on a lawn and garden, hand-held flexible line trimmer 1500. Preferably, the two-stroke engine 1502 is mounted on the top end of the trimmer 1500. With this arrangement, the two-stroke engine 1502 provides balance to the trimmer 1500, and the drive shaft of the engine 1502 may be oriented to transfer rotational torque through the main tube 1504 of the trimmer 1500. A pull cord 1506, or another type of starter, may be provided to allow the operator to start the engine 1502.

A first handle 1508 may be provided adjacent the engine 1502 and coaxial with the main tube 1504. Preferably, the first handle 1508 is located near the center of gravity of the trimmer 1500. The first handle 1508 may also include a control lever 1510 to allow the operator to control the speed and/or power of the two-stroke engine 1502. A second handle 1512 may also be provided. The second handle 1512 is preferably located at a distance from the first handle 1508 that makes it comfortable for the operator to carry the trimmer 1500 by the first handle 1508 and the second handle 1512 at the same time. A rotating, flexible line 1514 is located at the bottom end of the trimmer 1500 and is typically used to cut grass and other law and garden vegetation. As well-understood by those skilled in the art, the rotating, flexible line 1514 is driven by the drive shaft of the engine 1502 through the main tube 1504.

One advantage of using the described two-stroke engine on a hand-held, lawn and garden piece of equipment is that two-stroke engines are relatively light weight and provide high power output per unit weight. Thus, in the case of the trimmer 1500 described above, the weight of the engine 1502 can be easily lifted by an operator. The engine 1502 also provides sufficient power to drive the rotating, flexible line 1514 for cutting desired vegetation or to operate other typical lawn and garden equipment. The two-stroke engines described above also may improve the operating performance of hand-held, lawn and garden equipment and lower combustion emissions.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

I claim:

1. A two-stroke internal combustion engine comprising:

at least one transfer passage between a crankcase and a combustion chamber of the engine;

an air channel in gaseous communication with a top portion of the at least one transfer passage and ambient;

a fuel injector in gaseous communication with the air channel, wherein said fuel injector injects fuel into said air channel; and a rotary shut-off valve connected to a crankshaft of the engine and operatively disposed to open and close gaseous communication between the crankcase and the at least one transfer passage.

2. A two-stroke internal combustion engine comprising:

at least one transfer passage between a crankcase and a combustion chamber of the engine;

an air channel in gaseous communication with a top portion of the at least one transfer passage and ambient;

a fuel injector in gaseous communication with the air channel, wherein said fuel injector injects fuel into said air channel;

a cylinder having a cylinder wall; and a reciprocating piston mounted within the cylinder; and wherein the piston has a circumferential channel that reciprocatingly establishes gaseous communication between the at least one transfer passage and the air channel.

3. The two-stroke internal combustion engine of claim 2, further comprising a rotary shut-off valve connected to a crankshaft of the engine and operatively disposed to open and close gaseous communication between the crankcase and the at least one transfer passage.

4. A two-stroke internal combustion engine comprising:

at least one transfer passage between a crankcase and a combustion chamber of the engine;

an air channel in gaseous communication with a top portion of the at least one transfer passage and ambient;

a fuel injector in gaseous communication with the air channel, wherein said fuel injector injects fuel into said air channel;

an intake system connected to a cylinder or block of the engine; and a rotary throttle valve disposed within the intake system adapted to control air flow into the block; wherein the fuel injector is disposed within the intake system between the rotary throttle valve and the bock, the fuel injector adapted to inject fuel into the air flow; and a low pressure pump supplying fuel to the fuel injector, the low pressure pump pressurizing the fuel to 1 to 10 psig; an electronic control unit, the fuel injector injecting fuel into the air flow in response to electrical signals generated by the electronic control unit; and a pressure regulator limiting a pressure of fuel supplied to the fuel injector.

5. The two-stroke internal combustion engine of claim 4, further comprising a diaphragm pump supplying fuel to the fuel injector, the diaphragm pump pumping the fuel in response to changes in pressure in the transfer passage; wherein the fuel injector comprises an electro-magnetic coil adapted to open and close communication between a fuel inlet to the fuel injector and an outlet of the fuel injector, the electro-magnetic coil being responsive to the electronic control unit; and the fuel injector comprises a spring biasing a plunger to close communication between the fuel inlet to the fuel injector and the outlet of the fuel injector.

6. The two-stroke internal combustion engine of claim 5, further comprising a reed valve disposed between the fuel injector and the transfer passage, the reed valve adapted to open gaseous communication between the intake system and the transfer passage when a first pressure within the transfer passage is less than a second pressure within the intake system and close gaseous communication when the first pressure is greater than the second pressure; wherein the pressure regulator comprises a spring biasing a valve to seal the valve, the fuel supply unsealing the valve above a predetermined pressure thereby allowing fuel to pass by the valve; and further comprising a purge line connected to the fuel injector, the purge line adapted to purge air from fuel supplied to the fuel injector.

7. A two-stroke engine comprising:

at least one transfer passage between a crankcase and a combustion chamber of the engine;

an air channel in gaseous communication with a top portion of the at least one transfer passage and ambient;

a fuel injector in gaseous communication with the air channel, wherein said fuel injector injects fuel into the crankcase; and a rotary shut-off valve connected to a crankshaft of the engine and operatively disposed to open and close gaseous communication between the crankcase and the at least one transfer passage.

8. A two-stroke engine comprising:

at least one transfer passage between a crankcase and a combustion chamber of the engine;

an air channel in gaseous communication with a top portion of the at least one transfer passage and ambient;

a fuel injector in gaseous communication with the air channel, wherein said fuel injector injects fuel into the crankcase;

a cylinder having a cylinder wall; and a reciprocating piston mounted within the cylinder; and wherein the piston has a circumferential channel that reciprocatingly establishes gaseous communication between the at least one transfer passage and the air channel.

9. The two-stroke engine of claim 8, further comprising a rotary shut-off valve connected to a crankshaft of the engine and operatively disposed to open and close gaseous communication between the crankcase and the at least one transfer passage.

10. A two-stroke internal combustion engine comprising:

an intake system connected to a block of the engine;

a rotary throttle valve disposed within the intake system adapted to control air flow into the block;

a fuel injector disposed within the intake system between the rotary throttle valve and the block, the fuel injector adapted to inject fuel into the air flow; and a low pressure pump supplying fuel to the fuel injector, the low pressure pump pressurizing the fuel to 1 to 10 psig.

11. A two-stroke internal combustion engine comprising:

an intake system connected to a block of the engine;

a rotary throttle valve disposed within the intake system adapted to control air flow into the block;

a fuel injector disposed within the intake system between the rotary throttle valve and the block, the fuel injector adapted to inject fuel into the air flow; and a low pressure pump supplying fuel to the fuel injector, the low pressure pump pressurizing the fuel to 1 to 10 psig; an electronic control unit, the fuel injector injecting fuel into the air flow in response to electrical signals generated by the electronic control unit; and a pressure regulator limiting a pressure of fuel supplied to the fuel injector.

12. The two-stroke internal combustion engine of claim 11, further comprising a diaphragm pump supplying fuel to the fuel injector, the diaphragm pump pumping the fuel in response to changes in pressure in a crankcase of the engine; wherein the fuel injector comprises an electro-magnetic coil adapted to open and close communication between a fuel inlet to the fuel injector and an outlet of the fuel injector, the electro-magnetic coil being responsive to the electronic control unit; and the fuel injector comprises a spring biasing a plunger to close communication between the fuel inlet to the fuel injector and the outlet of the fuel injector.

13. The two-stroke internal combustion engine of claim 12, further comprising a reed valve disposed between the fuel injector and the block, the reed valve adapted to open gaseous communication between the intake system and the block when a first pressure within the block is less than a second pressure within the intake system and close gaseous communication when the first pressure is greater than the second pressure; wherein the pressure regulator comprises a spring biasing a valve to seal the valve, the fuel supply unsealing the valve above a predetermined pressure thereby allowing fuel to pass by the valve; and further comprising a purge line connected to the fuel injector, the purge line adapted to purge air from fuel supplied to the fuel injector.

14. A two-stroke internal combustion engine comprising:

a first passage in communication with a crankcase chamber, a first throttle valve disposed to control air flow into the first passage;

a second passage in communication with the crankcase chamber, a second throttle valve disposed to control air flow into the second passage, a fuel injector being disposed to inject fuel into the second passage;

a third passage in communication with the crankcase chamber, a third throttle valve disposed to control air flow into the third passage;

wherein the second passage is disposed between the first passage and the third passage, the first throttle valve and the third throttle valve being closed at low throttle speeds and the second throttle valve remaining at least partially open at low throttle speeds, air flow to the crankcase chamber thereby being constrained through the second passage at low throttle speeds; and wherein the first passage and the third passage do not include fuel injectors disposed therein, the first throttle valve, the second throttle valve and the third throttle valve being open at higher throttle speeds with fuel being provided substantially only through the second passage.

15. The two-stroke internal combustion engine of claim 14, wherein:

the first passage is in communication with a first transfer port to a combustion chamber, the first transfer port being located at a first position along a cylinder wall;

the second passage is in communication with a second transfer port to the combustion chamber, the second transfer port being located at a second position along the cylinder wall;

the third passage is in communication with a third transfer port to the combustion chamber, the third transfer port being located at a third position along the cylinder wall;

wherein the first position of the first transfer port and the third position of the third transfer port are higher along the cylinder wall than the second position of the second transfer port, the first transfer port and the third transfer port thereby opening before the second transfer port as a piston moves downward within the combustion chamber.

16. A two-stroke internal combustion engine comprising:

a first passage in communication with a first transfer port to a combustion chamber, a first throttle valve disposed to control air flow into the first passage, the first transfer port being located at a first position along a cylinder wall;

a second passage in communication with a second transfer port to the combustion chamber, a second throttle valve disposed to control air flow into the second passage, the second transfer port being located at a second position along the cylinder wall, a fuel injector being disposed to inject fuel into the second passage;

wherein the first position of the first transfer port is higher along the cylinder wall than the second position of the second transfer port, the first transfer port thereby opening before the second transfer port as a piston moves downward within the combustion chamber; and a third passage in communication with a third transfer port to the combustion chamber, a third throttle valve disposed to control air flow into the third passage, the third transfer port being located at a third position along the cylinder wall, wherein the second transfer port is disposed between the first transfer port and the third transfer port, the first passage and the third passage not including fuel injectors disposed therein, fuel thereby being provided substantially only through the second transfer port.

17. The two-stroke internal combustion engine of claim 16, wherein:

the first passage is in communication with a crankcase chamber;

the second passage is in communication with the crankcase chamber;

the third passage is in communication with the crankcase chamber;

wherein the first throttle valve and the third throttle valve are closed at low throttle speeds and the second throttle valve remaining at least partially open at low throttle speeds, air flow to the combustion chamber thereby being constrained through the second transfer port at low throttle speeds, the first throttle valve, the second throttle valve and the third throttle valve being open at higher throttle speeds.

* * * * *

UNITED STATES PATENT AND TRADEMARK OFFICE

CERTIFICATE OF CORRECTION

PATENT NO. : 7,331,315 B2
APPLICATION NO. : 11/351318
DATED : February 19, 2008
INVENTOR(S) : Nagesh S. Mavinahally It is certified that error appears in the above-identified patent and that said Letters Patent is hereby corrected as shown below:

In the Claims

Column 14, in claim 4, line 34, after "throttle valve and the" delete "bock" and substitute --block-- in its place.

Signed and Sealed this

Twelfth Day of August, 2008

JON W. DUDAS
*Director of the United States Patent and Trademark Office*